US009663285B2

(12) United States Patent
Albaum

(10) Patent No.: US 9,663,285 B2
(45) Date of Patent: May 30, 2017

(54) CONTAINERS AND METHODS FOR ISOLATING LIQUIDS PRIOR TO DISPENSING

(75) Inventor: Gary J. Albaum, Pleasantville, NY (US)

(73) Assignee: Kraft Foods Group Brands LLC, Chicago, IL (US)

( * ) Notice: Subject to any disclaimer, the term of this patent is extended or adjusted under 35 U.S.C. 154(b) by 0 days.

(21) Appl. No.: 13/994,087

(22) PCT Filed: Dec. 13, 2011

(86) PCT No.: PCT/US2011/064583

§ 371 (c)(1),
(2), (4) Date: Sep. 5, 2013

(87) PCT Pub. No.: WO2012/082712

PCT Pub. Date: Jun. 21, 2012

(65) Prior Publication Data

US 2013/0334250 A1 Dec. 19, 2013

Related U.S. Application Data

(60) Provisional application No. 61/423,037, filed on Dec. 14, 2010.

(51) Int. Cl.

| | |
|---|---|
| ***B67D 7/74*** | (2010.01) |
| ***B67B 7/00*** | (2006.01) |
| ***B65D 81/32*** | (2006.01) |

(52) U.S. Cl.

CPC ..... *B65D 81/3272* (2013.01); *B65D 81/3227* (2013.01)

(58) Field of Classification Search

CPC ..... B65D 81/3272; B65D 81/3227

(Continued)

(56) References Cited

U.S. PATENT DOCUMENTS 3,200,995 A * 8/1965 Gangwisch ..... B65D 47/242 222/145.5
3,850,346 A * 11/1974 Richardson et al. ..... 222/145.7

(Continued)

FOREIGN PATENT DOCUMENTS

FR 2078627 A5 11/1971
GB 965508 A 7/1964

(Continued)

OTHER PUBLICATIONS

International Search Report dated Mar. 29, 2012 for PCT/US2011/064583 (3 pgs.).

(Continued)

*Primary Examiner* — Vishal Pancholi
(74) *Attorney, Agent, or Firm* — Fitch, Even, Tabin & Flannery LLP

(57) ABSTRACT

A container for isolating first and second fluids, such as beverage concentrate components, until dispensing is provided, as well as methods of assembly and dispensing. The container can have a body for containing the first fluid and an insert, received at least partially within the body, for containing the second fluid and isolating the first and second fluids. A first fluid exit path and a second fluid exit path can both be blocked by a valve member. When the valve member is moved to an open position, flow through both the first and second fluid exit paths can occur.

35 Claims, 17 Drawing Sheets

(58) Field of Classification Search
USPC ..... 222/129, 142.5, 145.1, 145.5, 490, 499, 222/544; 215/11.1, 228, 310, 311, 307; 220/23.83, 23.87, 23.89
See application file for complete search history.

(56) References Cited

U.S. PATENT DOCUMENTS

| | | | | |
|---|---|---|---|---|
| 4,585,149 | A | 4/1986 | Zulauf | |
| 5,328,056 | A | 7/1994 | Schneider | |
| 5,632,420 | A * | 5/1997 | Lohrman et al. | 222/212 |
| 6,250,346 | B1 | 6/2001 | Castillo | |
| 6,398,077 | B1 | 6/2002 | Gross | |
| 6,609,634 | B2 | 8/2003 | de Laforcade | |
| 6,880,725 | B2 | 4/2005 | de Laforcade | |
| 6,997,353 | B2 * | 2/2006 | Decottignies | B65D 83/0055 222/105 |
| 7,044,334 | B2 | 5/2006 | Mita | |
| 7,435,027 | B2 * | 10/2008 | Hetzel | 401/47 |
| 2003/0106910 | A1 | 6/2003 | Hicks et al. | |
| 2006/0021996 | A1 | 2/2006 | Scott | |
| 2007/0029352 | A1 * | 2/2007 | Norris et al. | 222/494 |
| 2007/0267436 | A1 | 11/2007 | Abbott | |
| 2008/0230540 | A1 * | 9/2008 | Marra et al. | 220/23.89 |
| 2008/0237271 | A1 | 10/2008 | Olechowski | |
| 2009/0026222 | A1 * | 1/2009 | Seelhofer | 222/129 |
| 2009/0114677 | A1 | 5/2009 | Stuart | |
| 2009/0152294 | A1 | 6/2009 | Mizell | |
| 2009/0267436 | A1 | 10/2009 | Stiesdal | |
| 2009/0272759 | A1 | 11/2009 | Bambrick | |
| 2010/0075001 | A1 | 3/2010 | Succar | |
| 2010/0102085 | A1 | 4/2010 | Kanfer | |

FOREIGN PATENT DOCUMENTS

| | | | |
|---|---|---|---|
| JP | 5016975 | A | 1/1993 |
| WO | 2007053970 | A1 | 5/2007 |

OTHER PUBLICATIONS

English translation of Second Office Action for China Patent Application No. 2011800675069 (2 pgs.).
Examination report, dated Aug. 12, 2014 for European Patent Application No. 11799590.2 (4 pgs.).
First Examination Report, dated Dec. 4, 2013 for New Zealand Patent Application No. 6120914 (2 pgs.).
English translation of Office Action for Russion Patent Application No. 2013131782 (2 pgs.).
Patent Examination Report No. 1, dated Oct. 28, 2015 for Australian Patent Application No. 2011344024 (2 pgs.).
English translation of First Office Action for China Patent Application No. 2011800675069 (6 pgs.).

* cited by examiner

CONTAINERS AND METHODS FOR ISOLATING LIQUIDS PRIOR TO DISPENSING

CROSS REFERENCE TO RELATED APPLICATIONS

This application is a U.S. national phase application of International Application No. PCT/US2011/064583, filed Dec. 13, 2011, designating The United States of America, which claims the benefit of U.S. patent application No. 61/423,037, filed Dec. 14, 2010, both of which are hereby incorporated by reference in their entirety.

FIELD

This description relates to containers and methods for isolating liquids until dispensing and, in particular, with respect to isolating and dispensing different liquids forming at least part of a beverage.

BACKGROUND

Concentrated liquids can be used to decrease the size of packaging needed to supply a desired quantity of end result product. However, some concentrated liquids may have a shelf life that is less that desired due to certain components. For example, an acid, such as citric or malic acid, added to a liquid concentrate can decrease the shelf life of the liquid concentrate.

Various attempts have been made to separate different components from each other prior to dispensing. Some of those attempts involve providing a device with a smaller chamber having a wall that is punctured to disperse their contents into a larger chamber, such as described in U.S. Pat. No, 7,017,735. Other attempts are described in U.S. Patent Appl. Publ. Nos. 2008/0116221; 2009/0236303; 2008/0245683. One drawback of such devices is that the smaller chamber can undesirably impede dispensing of the combined components. Indeed, in some instances the smaller chamber is removed after it has been punctured. This can limit the functionality and convenience of the devices. Another drawback of such devices is that they are intended to mix all of the two liquids together at the time of first use. This can be disadvantageous when the mixed liquids are not intended to be consumed at the time of first use, but rather over time.

Yet another problem with concentrated liquids is that they can include concentrated amounts of dye so that after mixing, the resulting product has the desired coloring. These dyes can stain surfaces, such as clothes, skin, etc., if they come into contact with the surfaces Due to this, a container storing a concentrated liquid is undesirable if it allows the liquid concentrate to drip or otherwise leak from the container in an uncontrolled manner. One form of container releases a stream of liquid out of an opening when squeezed by a user. When this type of container is utilized to store a concentrated liquid, at least two problems can occur. First, due to the staining problem discussed above, if the concentrated liquid is squeezed into a container having a second liquid therein, undesirable splashing can occur when the stream of concentrated liquid impacts the liquid in the container. This splashed material can then stain the surrounding surfaces, as well as the clothes and skin of a user.

Additionally, unlike squeeze containers storing more solid contents where the amount of material being dispensed can be visually assessed, such as a ketchup or salad dressing bottle, a squeeze container dispensing a liquid concentrate into another liquid can disadvantageously be hard for a user to assess how much concentrated liquid has been dispensed in order to achieve the desired end mixture. Yet another problem can occur as the level of concentrated liquid remaining in the container is reduced during repeated uses. In this situation, the amount of concentrated liquid dispensed using the same squeeze force can disadvantageously change significantly as the liquid concentrate level changes within the container.

SUMMARY

A container is provided for isolating a first liquid and a second liquid prior to dispensing. The container includes an enclosed body for containing the first, liquid and having an opening. The container also includes an insert, at least partially received within the body, for containing the second liquid and to at least partially isolate the first and second liquids. The container defines a first exit flow path for dispensing the first liquid from the body, as well as a second exit flow path for dispensing the second liquid from the insert. A valve member of the container is moveable from a closed position, blocking both the first and second exit flow paths and maintaining isolation of the first and second liquids upstream of the valve, to an open position, permitting flow through both the first and second exit flow paths to dispense the first and second liquids from the container. Advantageously, the container may utilize a single valve member to block flow through both the first and second exit flow paths.

In one aspect of the container, the valve member, first exit flow path and second exit flow path can be configured to permit mixing of the first and second fluids upstream of the valve when the valve is in the open position.

In another aspect, the insert can have a valve seat surrounding an exit opening of the insert. The first exit flow path can be defined in part by an outer portion of the valve seat, such as between the outer portion of the valve seat and an adjacent portion of the body. The second exit flow path can be defined in part by an inner portion of the valve seat, such as an opening therethrough.

In another aspect, the valve member can be a flexible diaphragm moveable from the closed position, seated on the valve seat, to the open position, at least partially spaced from the valve seat. The flexible diaphragm can include one or more slits that can flex to form an opening for dispensing the first and second liquids from the container when in the open position.

In another aspect, the body may include a neck disposed about the opening and the insert can be at least partially supported by the neck. To support the insert, an outwardly extending protuberance thereof can cooperate with an inwardly extending rib of the neck. The protuberance of the insert can be formed on a peripherally-extending flange of the insert, and the flange can be configured to have one or more passages therepast to define a bypass segment of the first exit flow path extending between the neck and the exterior of the insert.

In yet another aspect, the valve seat and exit opening can be formed in an upper portion of the insert. The exit opening can be in fluid communication with a downwardly extending compartment containing the second fluid. The compartment can be spaced from the protuberance of the insert by a neck having a narrowed cross-section as compared to a cross-section of the compartment.

The insert may include an upper seat member and a lower stem member, whether integral or separate. The upper seat member can incorporate the valve seat and the lower stem member can be in fluid communication with the compartment, such as by being attached to or integral with the compartment. The upper seat member and lower stem member can cooperate to form a fluid exit Passage upstream of the exit opening. The aforementioned protuberance of the insert can be formed on a peripherally-extending flange of the lower stem member. The flange can have one or more passages therepast to define in part the bypass segment of the first exit flow path. The upper seat member can have one or more passages therepast to define in part the bypass segment of the first exit flow path.

In any of the aspects described herein, the container can include a cap attached to the neck of the body. The foregoing upper seat member can be retained by the cap. The cap and upper seat member can include means for retaining the upper seat member on the cap, and the lower stem member and neck can include means for retaining the lower stem member on the neck. The valve member is attached to the cap. This can facilitate assembly, as the body can be filled without the valve member present. Further, the insert can be filled faster, particularly when filled after insertion into the body, due to the upper seat member—and its restriction—not being present. The cap can includes a lid moveable to selectively block access to the valve member.

A method is provided for assembling a container for isolating a first liquid and a second liquid prior to dispensing, such as those containers described herein. The method can include filling an outer body of the container with a first liquid through an opening thereof; filling an insert with the second liquid before, during or after at least partially inserting the insert into the outer body of the container through the opening thereof; and attaching a cap having a valve member to the outer body. The valve member can be moveable from a closed position blocking mixing of the first and second fluids to an open position permitting dispensing of the first and second fluids together.

In one aspect of the method for assembling a container, the step of at least partially inserting the insert can include supporting the insert with a neck of the outer body. In another aspect, the insert can include a valve seat and the step of attaching the cap to the outer body can further include the step of aligning the cap such that the valve member is positioned to engage the valve seat when in the closed position. In yet another aspect, the insert can have a lower compartment for the second fluid and an upper seat member having the valve seat, and the method can further comprise attaching the upper seat member to the cap and supporting the lower compartment with the neck of the outer body. The step of attaching a cap to the outer body can include the step of forming a fluid passage between the lower compartment and the upper seat member. In another aspect, the insert can be a unitary body.

A method is provided of dispensing a first liquid and a second liquid from a container, such as those described herein, which isolates the first liquid and a second liquid prior to dispensing using a common valve member. The method includes squeezing the container to cause the valve member to move from a closed position blocking mixing of the first and second fluids upstream of the valve member to an open position permitting dispensing of the first and second fluids together; and dispensing the first and second liquids together from the container when the valve member is in the open position.

In one aspect of the method for dispensing, the step of dispensing the first and second liquids includes the step of dispensing the first and second liquids through an opening in the valve member. In another aspect, the method can include the step of opening a lid of a cap of the container, with the lid blocking dispensing of the first and second liquids when closed.

DETAILED DESCRIPTION

Figure 1:
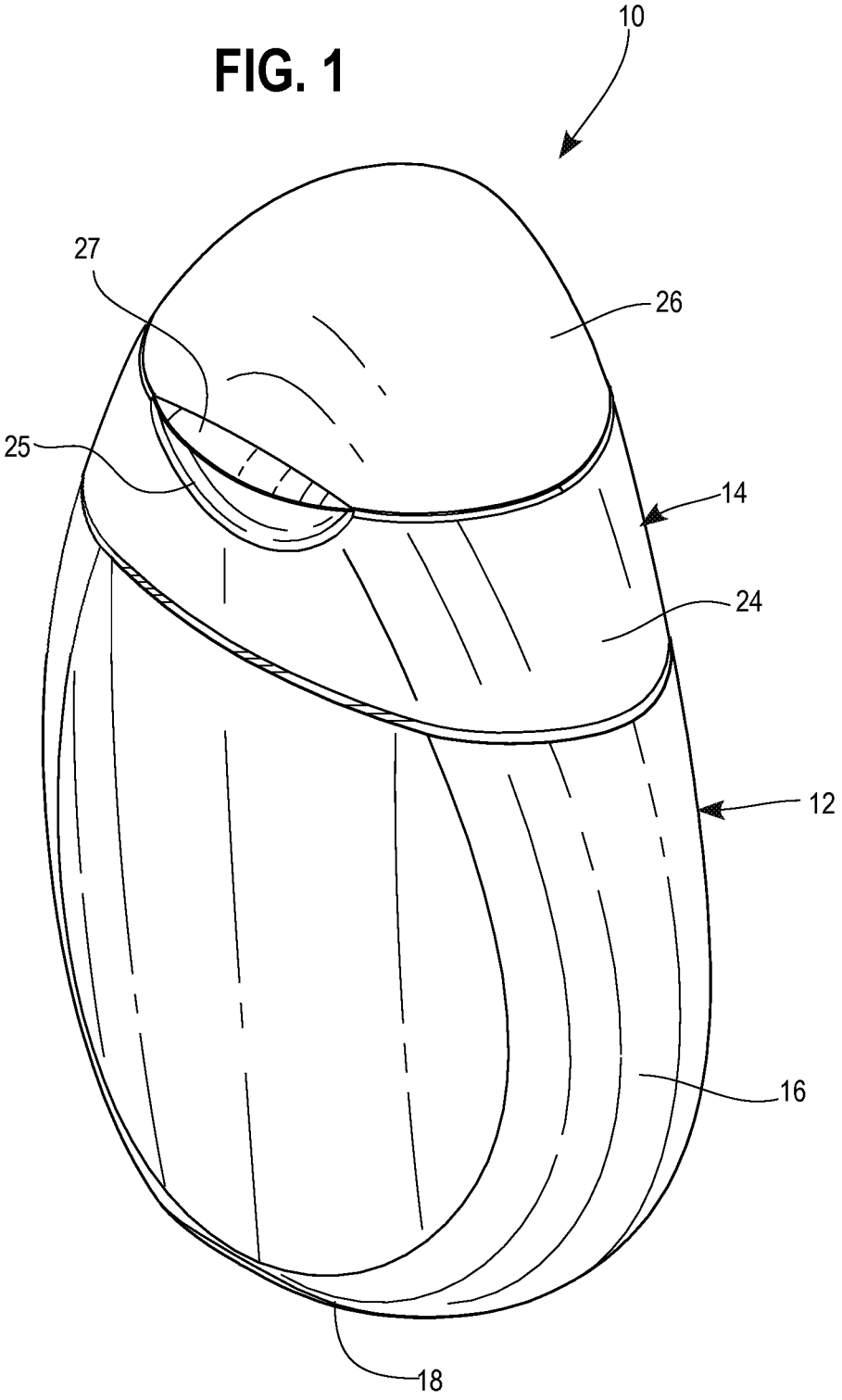
FIG. 1 is a perspective view of an exemplary container for dispensing beverage concentrates, showing the container body with a cap having a lid.
Figure 2:
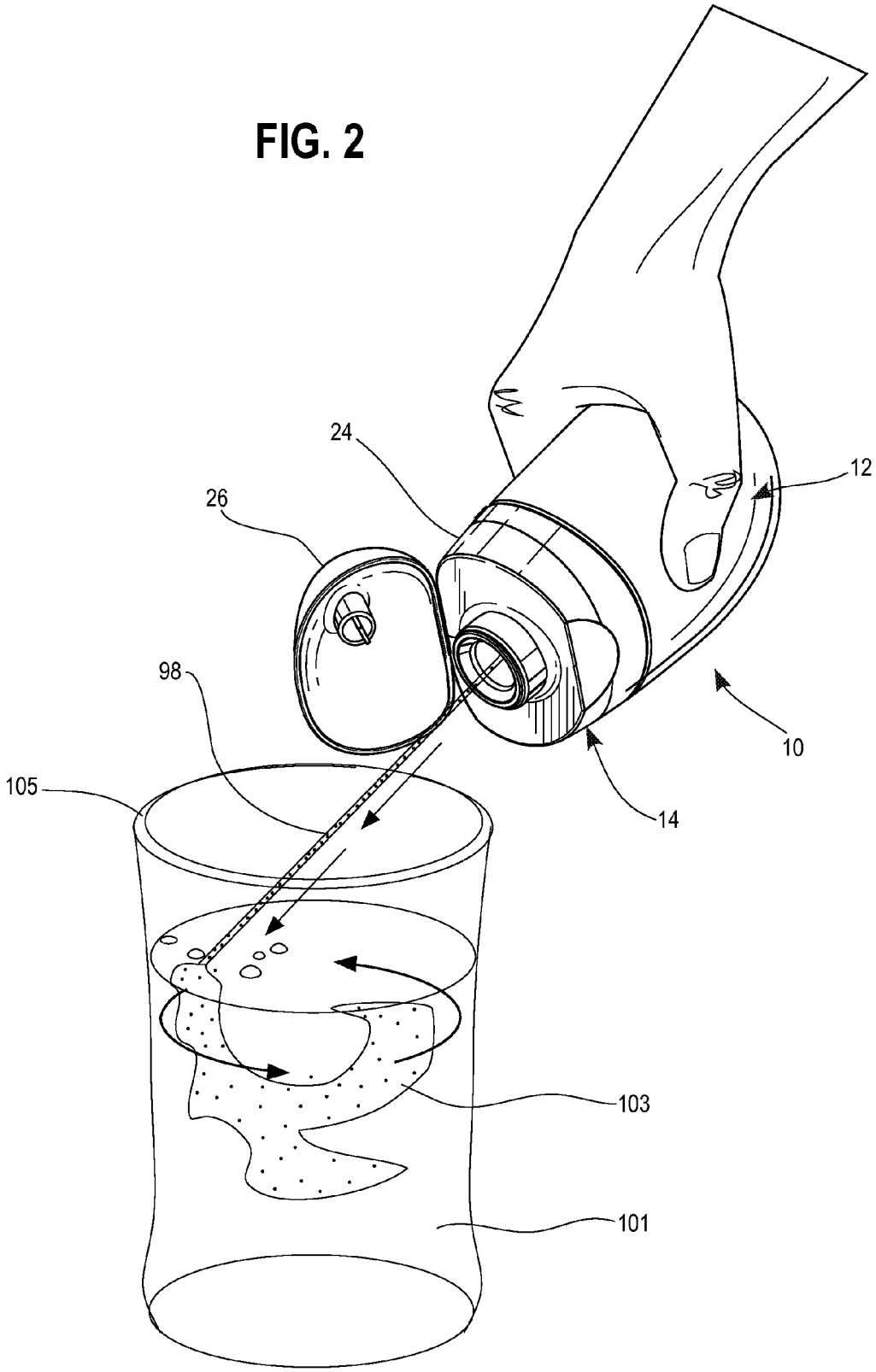
FIG. 2 is a perspective view of the container of FIG. 1 containing the beverage concentrate, with the lid of the cap open and the body being squeezed to dispense the beverage concentrate as a jet into a glass of water.

Containers configured for isolating a first and second fluid prior to dispensing and then combining during dispensing are provided, as well as methods of assembly and dispensing. The container is suitable for multiple dispenses, and the fluids can be components of a beverage or beverage concentrate. Advantageously, the first and second fluids are kept separate prior to dispensing. Also advantageously, preferably only or substantially only the dispensed portions of the first and second fluids are mixed during dispensing. That is, not all of the first and second fluids are mixed during a given dispense cycle. The isolation of the dispensed portions of the first and second fluids until dispensing can restrict or prevent the ability of one of the fluids to interact with the other of the fluids. Avoiding such interaction can increase the shelf life of the filled container, such as when interaction of the fluids could decrease the shelf life. Such isolation can be achieve while still providing for a container that does not require complicated steps for dispensing.

With reference to the exemplary embodiments of FIGS. 1-25, the container 10 includes a body 12 with a cap 14 attached to the top. Positioned beneath the underside of the cap 14 is an insert or cartridge assembly 30 or 87, as illustrated in FIGS. 5-7, 11-13 and 20. The body 12 includes a first fluid 90 and the insert 30 or 87 contains a second fluid 92. Initially, first and second fluids, in the exemplary case first and second beverage concentrate components 90 and 92, are maintained separately in isolation. However, when it is desirable to dispense a portion (or all of the components 90 and 92, a valve member 50 is moved from a closed position to an open position whereby the first and second beverage components and 92 can exit the body 12 and insert 30 or 87, respectively, together.

Figure 15:
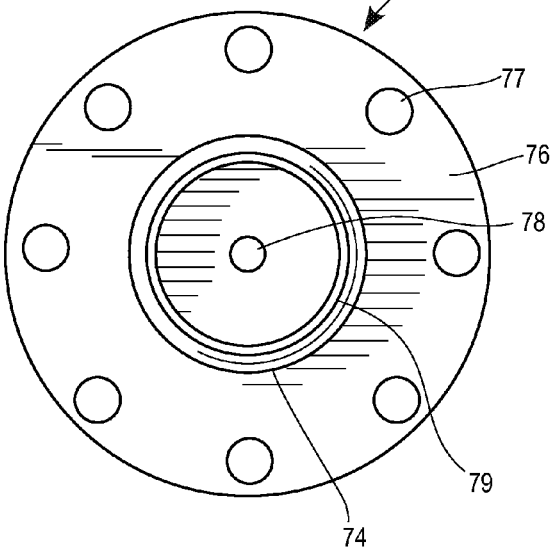
FIG. 15 is a top plan view of the upper insert of the second container embodiment shown in FIG. 11.

More specifically, each of the first and second beverage components 90 and 92 has an associated and separate exit flow path upstream of the valve when the valve member 50 is in its closed position. When the valve member 50 moves to its open position, portions of the first and second beverage components 90 and 92 can flow through their respective exit flow paths, mix upstream of the valve member 50 and then pass the valve member 50 for dispensing. The beverage concentrate 94 can then he dispensed into water or other liquid, as illustrated in FIG. 15, to form a beverage. Exemplary beverage concentrates are disclosed in WO/2011/031985, published Mar. 17, 2011 and U.S. Pat. Appl. Nos. 61/438,536, filed May 20, 2011; 61/523,085, filed Aug. 12, 2011; and 61/532,991, filed Sep. 9, 2011, which are hereby incorporated by reference in their entireties. The volume ratio between the first and second beverage components can be between about 1:1 and 9:1, between about 1:1 and 4:1, or about 2:1. Suitable sizes of the container, further details of its construction, exemplary beverage concentrates and the numbers of doses therein are discussed in the applications reference in this paragraph.

Figure 5:
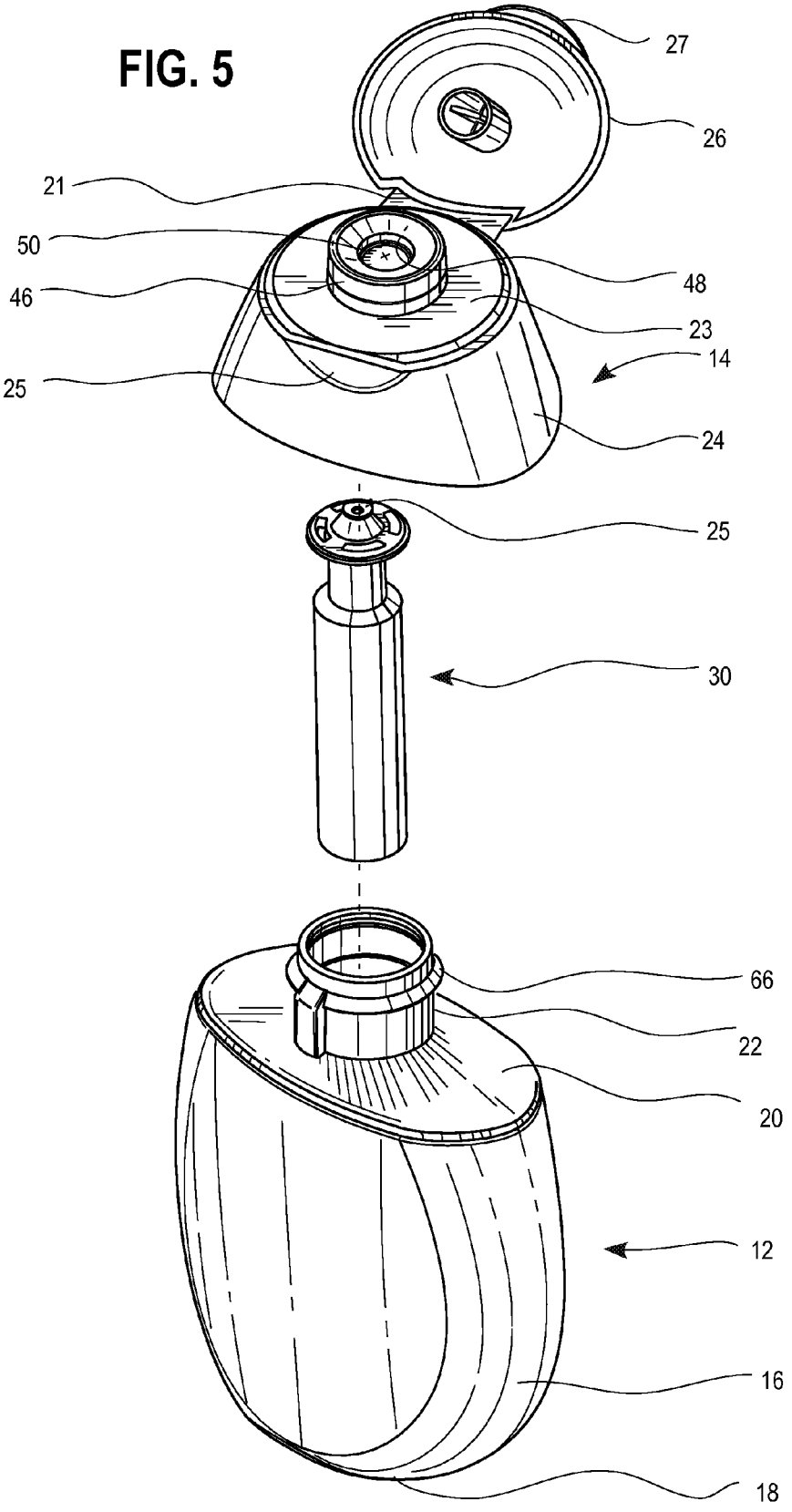
FIG. 5 is an exploded perspective view of a first embodiment of the container of FIG. 1 with a rigid, one-piece inner insert or cartridge for containing a first component of the beverage concentrate in isolation from a second component of the beverage concentrate in the body of the container.

Turning to details of the container 10, and with reference to FIGS. 1 and 5, the body 12 is enclosed by a bottom wall 13, an opposite shoulder 20 at the top portion of the body 12 and a sidewall 16 extending between the shoulder 20 and the bottom wall 18. A neck 22 extends upward from the shoulder 20 opposite the bottom wall 18 and defines an opening into an interior of the body 12. The neck 22 includes structure for mounting of the cap 14 and for supporting some or all of the insert 30 or 87, as will be described in greater detail herein.

The cap 14 is attached to the neck 22 of the body 12 of the container 10. The cap 14 includes a top wall 23, as illustrated, in FIGS. 5, 11 and 20, with a depending skirt 24 about its periphery. A raised, cylindrical spout 46 defines an opening 48 extending through the top wall 23. A lid 26 of the cap 14 is generally dome shaped and configured to cover the spout. 46, In the illustrated form, the lid 26 is pivotably connected to the remainder of the cap 24 by a hinge 21. In one form, the lid 26 can be configured to snap fit with the remainder of the cap 14. In this form, a recessed portion 25 can be provided in the skirt 24 configured to be adjacent the lid 26 when the lid 26 is pivoted to a closed position. The recessed portion 25 can then facilitate access to a projecting ledge 27 of the lid 26 so that a user can manipulate the ledge 27 to open the lid 26.

Figure 4:
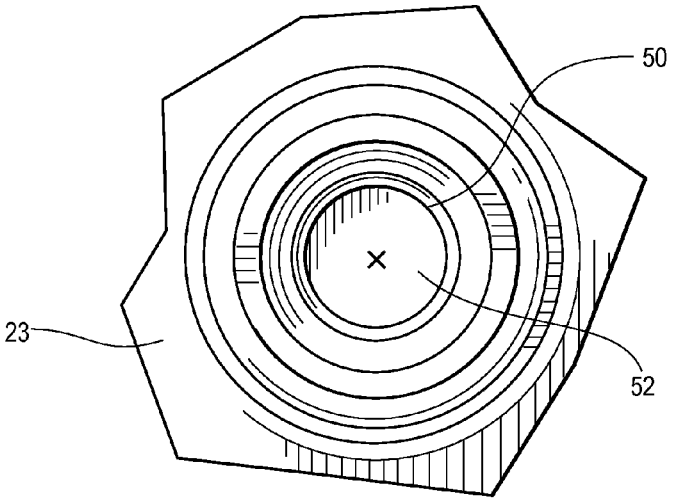
FIG. 4 is a top plan view of a valve of the lid of the container of FIG. 1.

Received within the opening 48 of the spout 46 is the valve member 50. The valve member 50 acts as a diaphragm, and has a flexible membrane or plate portion 52 with a plurality of slits therein, and preferably two intersecting slits forming four generally triangular flaps, as illustrated in FIG. 4. So configured, when the container 10 is squeezed, such as by depressing opposing portions of the sidewall 16 toward each other, the first and/or second beverage components 90 and 92 are forced against the membrane 52 which outwardly displaces the flaps to allow the components to both mix together to form a beverage concentrate 94 and exit therethrough in a jet 98, generally illustrated in FIG. 2. In one aspect, the jet of the beverage concentrate 94 preferably combines velocity and mass flow to impact a target liquid 101 within a target container 105 to cause turbulence in the target liquid 101 and create a generally uniform mixed end product 103 without the use the extraneous utensils or shaking.

Figure 6:
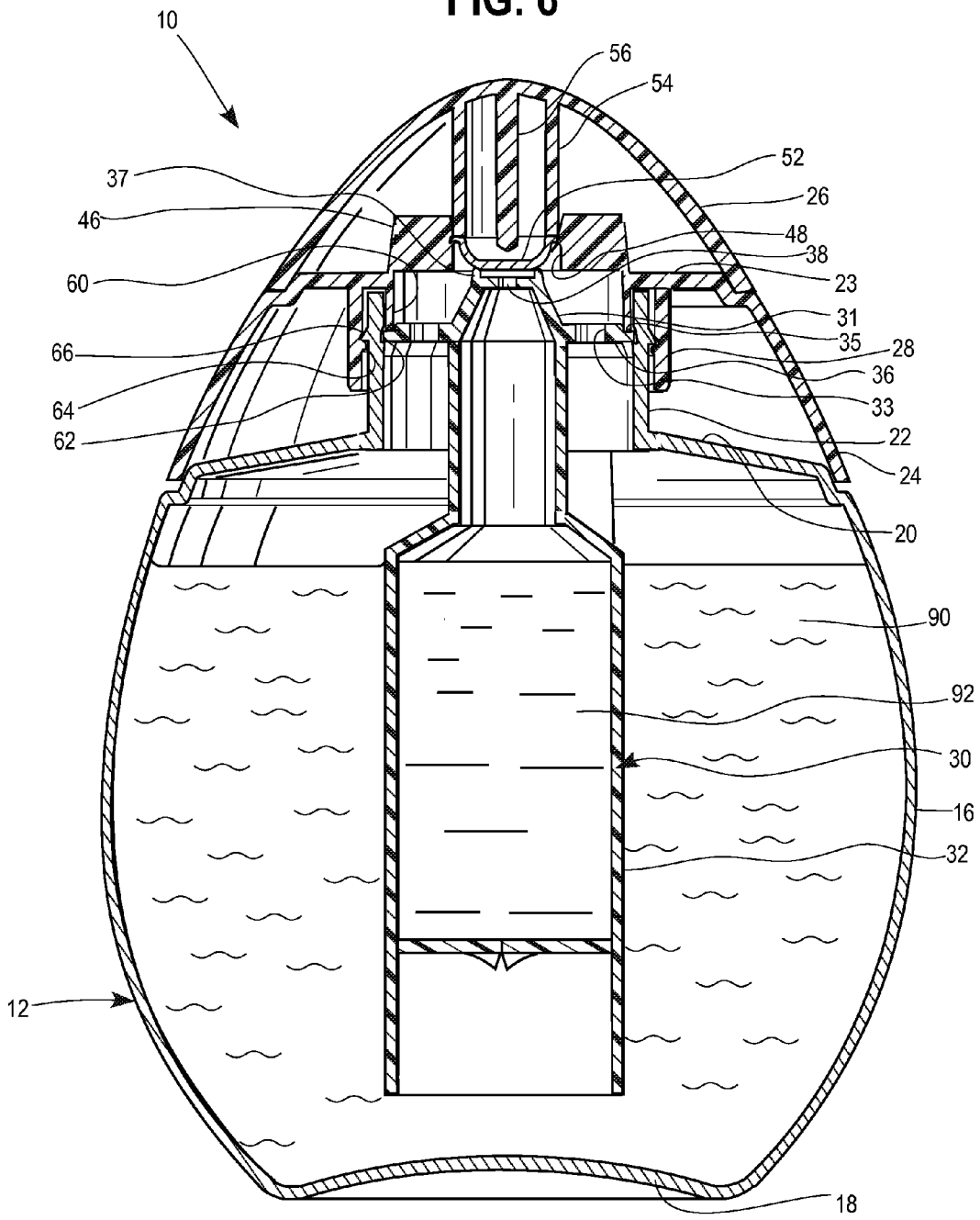
FIG. 6 is a cross-section view of the first embodiment of the container of FIG. 1 with the lid of the cap in a closed position and showing a non-dispensing position with the valve in a closed position blocking an exit flow path of the first component and an exit flow path of the second component.
Figure 12:
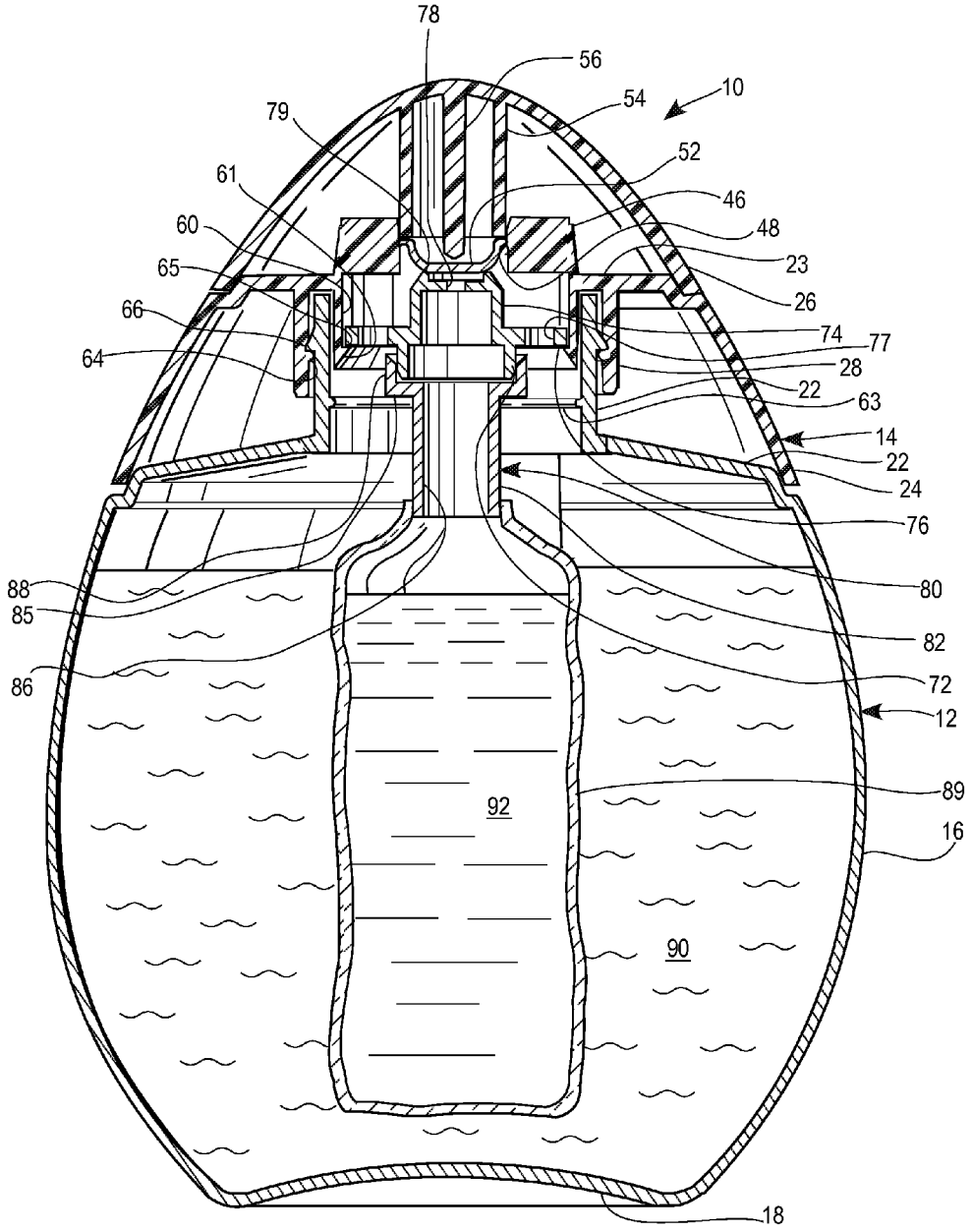
FIG. 12 is a cross-section view of the second embodiment of the container of FIG. 1 with the lid of the cap in a closed position and showing a non-dispensing position with the valve in a closed position blocking an exit flow path of the first component and an exit flow path of the second component.
Figure 20:
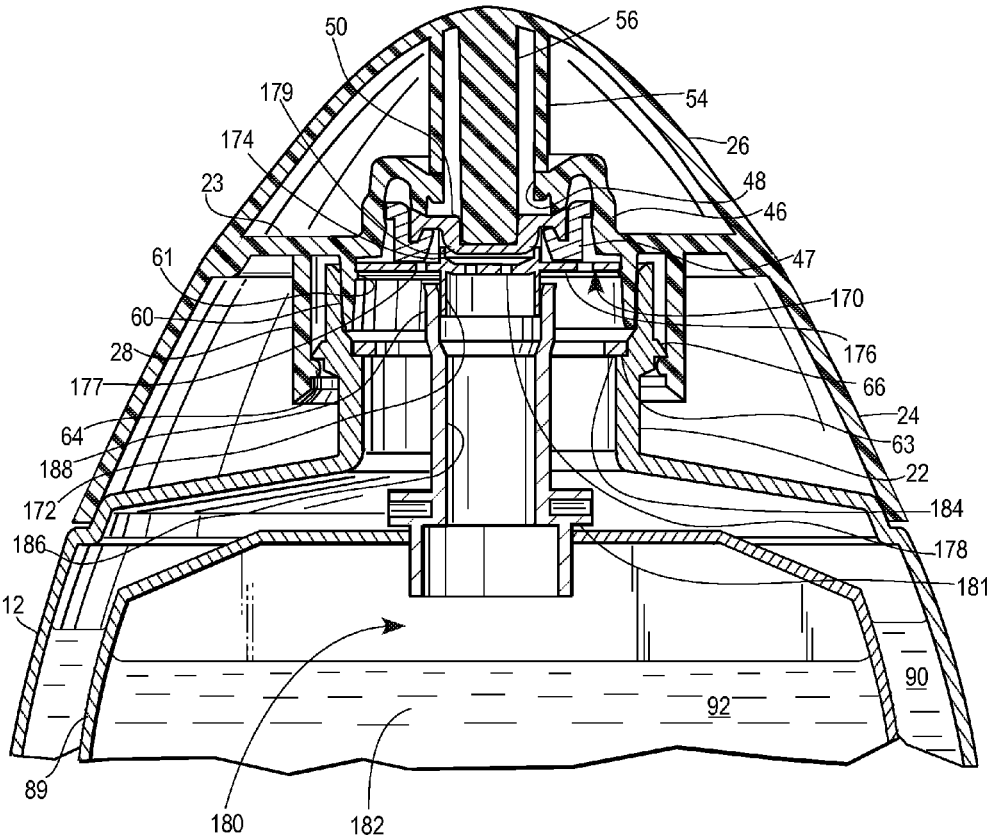
FIG. 20 is a cross-section view of a third embodiment of the container of FIG. 1 with the lid of the cap in a closed position and showing a non-dispensing position with the valve in a closed position blocking an exit flow path of the first component and an exit flow path of the second component, and showing an inner dispensing assembly comprising an upper insert, a lower insert and a flexible bag for containing a first component of the beverage concentrate in isolation from a second component of the beverage concentrate in the body of the container.

The lid 26 may further include a stopper 54 projecting from an interior surface of the lid 26. Preferably, the stopper 54 is sized to snugly fit within the spout 46, as illustrated in FIGS. 6, 12 and 20, to provide additional protection against unintended dispensing of the liquid beverage concentrate 94 or other leakage. The stopper 54 can be a hollow, cylindrical projection. An optional inner plug 56 can be disposed within the stopper and project further therefrom, and can contact the membrane 52 of the valve member 50 disposed in the opening 48 of the spout 46. More specifically, the inner plug 56 can restrict movement of the flaps of the valve member 50 from a concave orientation, whereby they are closed, to a convex orientation, whereby the flaps are at least partially open for dispensing.

The stopper 54 can be configured to cooperate with the spout 46 to provide one, two or more audible and/or tactile responses to a user during closing. For example, sliding movement of the rearward portion of the stopper 54 past the rearward portion of the spout 46—closer to the hinge 21—can result in an audible and tactile response as the lid 26 is moved toward a closed position. Further movement of the lid 26 toward its closed position can result in a second audible and tactile response as the forward portion of the stopper 54 slides past a forward portion of the spout 46—on an opposite side of the respective rearward portions from the hinge. Preferably the second audible and tactile response occurs just prior to the lid 26 being fully closed. This can provide audible and/or tactile feedback to the user that the lid 26 is closed.

Figure 3:
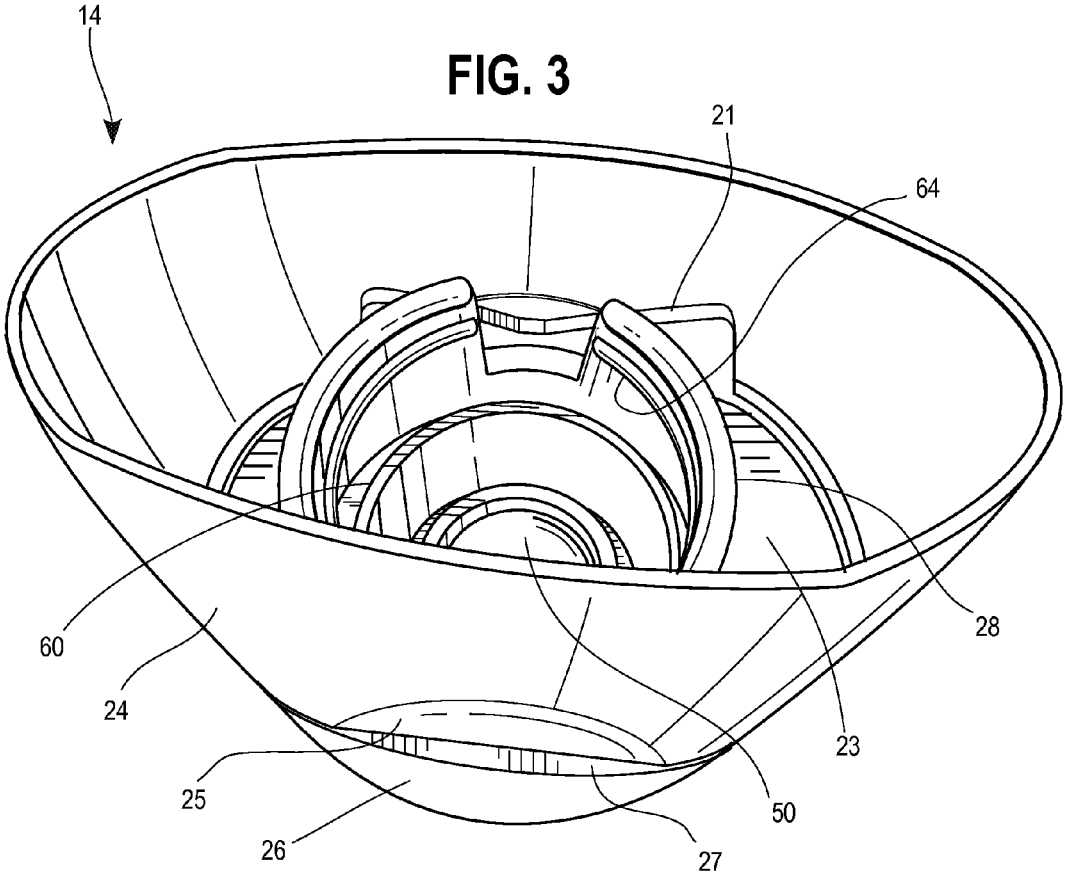
FIG. 3 is a perspective view of the underside of the lid of the container of FIG. 1.

The cap 14 has an outer, generally cylindrical flange 28 depending from the underside of the top wall 23, as shown in FIG. 3, that is configured to engage the outer surface of the neck 22, as shown in FIGS. 6, 7, 12, 13 and 20. The outer surface of the neck 22 includes, adjacent its open upper end, a downwardly inclined circumferential ramp 66, as illustrated in FIGS. 5-7, 11-13 and 20. The distal portion of the outer flange 28 of the cap 14 includes a circumferential, inwardly extending cap ramp 64. The ramp 64 of the cap 14 and the ramp 66 of the neck 22 are configured such that they can more readily be slid past each other when the cap 14 is pressed. downwardly about the neck 22 as compared to when removal of the cap 14 from the neck 22 is attempted. In this manner, the cap 14 can be attached to and retained on the neck 22 and hence the body 12 of the container 10. The use of the term retain does not mean that it is impossible to move from a given position; rather that there is some force that must he overcome in order to do so. In order to attach the cap 14 to the neck 22, the cap ramp 64 slides along the upper ramp 66 of the neck 22, with the neck 22 and/or the outer flange 28 of the cap 14 flexing away from each other until the ledges formed adjacent the respect ramps 64 and 66 interlock to restrict outward removal of the cap 14.

The cap 14 also includes an inner, generally cylindrical flange 60 depending from the underside of the top wall 23. The inner flange 60 is disposed inwardly from the outer flange 28, and extends downwardly a shorter distance from the bottom wall 23 of the cap 14. The spacing between the inner and outer flanges 60 and 28 is selected so that the upstanding, generally cylindrical neck 22 of the body 12 of the container 10 is received therebetween. The purpose of the inner flange 60 will be described in greater detail herein.

There are two different versions of inserts 30 or 87 disclosed in the three exemplary embodiments of containers illustrated in the Figures. In the first version, illustrated in the first embodiment of the container of FIGS. 5-10, the insert 30 is supported primarily by the neck 22 of the body 12 of the container—independent of the cap 14. Alternatively, the insert 30 could be supported primarily by the cap 14. In contrast, the insert 87 of the second version, illustrated in the second embodiment of the container of FIGS. 11-19 and in the third embodiment of the container of FIGS. 20-25, is supported in part by the neck 22 of the body 12 of the container 10 and in part by the cap 14; specifically, by the inner flange 60 of the cap 14.

Figure 8:
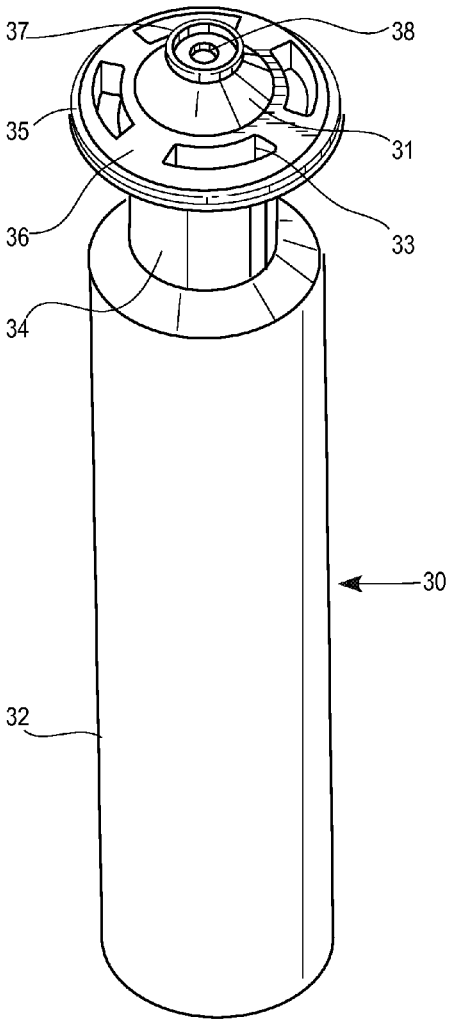
FIG. 8 is a perspective view of the one-piece, inner cartridge of the first embodiment shown in FIG. 5.
Figure 9:
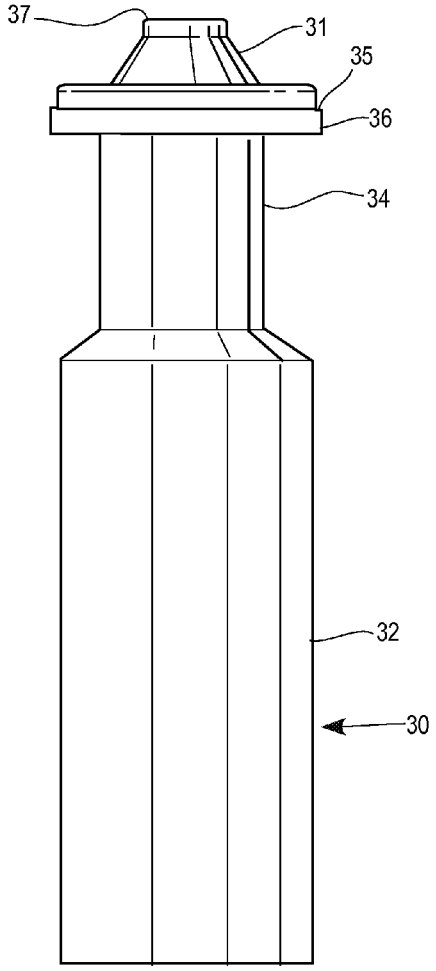
FIG. 9 is a side elevation view of the one-piece, inner cartridge of the first embodiment shown in FIG. 5.
Figure 10:
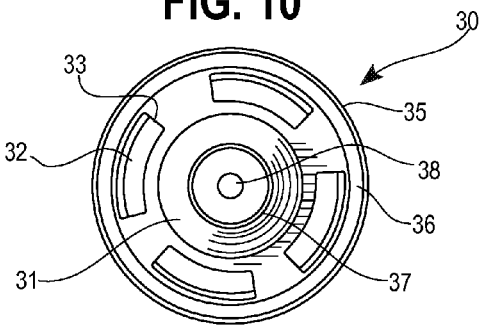
FIG. 10 is a top plan view of the one-piece, inner cartridge of the first embodiment shown in FIG. 5.
Figure 11:
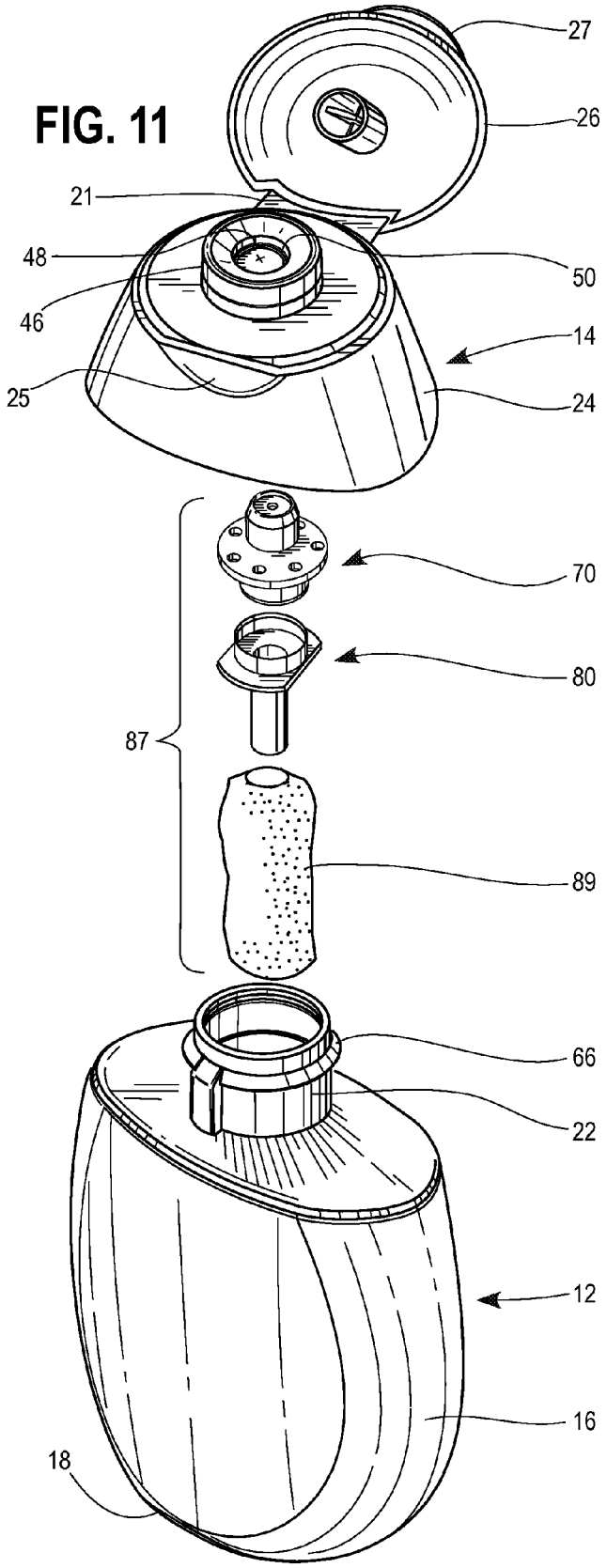
FIG. 11 is an exploded perspective view of a second embodiment of the container of FIG. 1 with an inner dispensing assembly comprising an upper insert, a lower insert and a flexible bag for containing a first component of the beverage concentrate in isolation from a second component of the beverage concentrate in the body of the container.

With respect to the first version, the insert 30 comprises a hollow, cylindrical body portion 32 configured to contain the second beverage component 92. The lower end region of the body portion 32 of the insert 30 is closed in a manner that permits the ingress of a greater amount of air than the volume of liquid discharged from the insert 30. This can be accomplished by having a bottom wall that is slidable within the body portion 32 toward the end thereof in order to permit the internal volume to expand, much like a syringe plunger. Instead or in addition, a one-way valve can be provided in a bottom wall (whether fixed or moveable) that permits internal air to be vented from the insert 30 and into the body 12. Opposite the lower end of the body portion of the insert is a narrowed, hollow, cylindrical portion 34 followed by a radially outwardly extending support flange 36 having a step 35 thereon, a truncated conical portion 31, and an upwardly projecting annular rim or valve seat 37 circumscribing an exit orifice 38, as depicted in FIGS. 8-10. A plurality of flow ports 33 extend through the support flange 36 of the insert 30 of the first embodiment for purposes that will be described herein.

Figure 7:
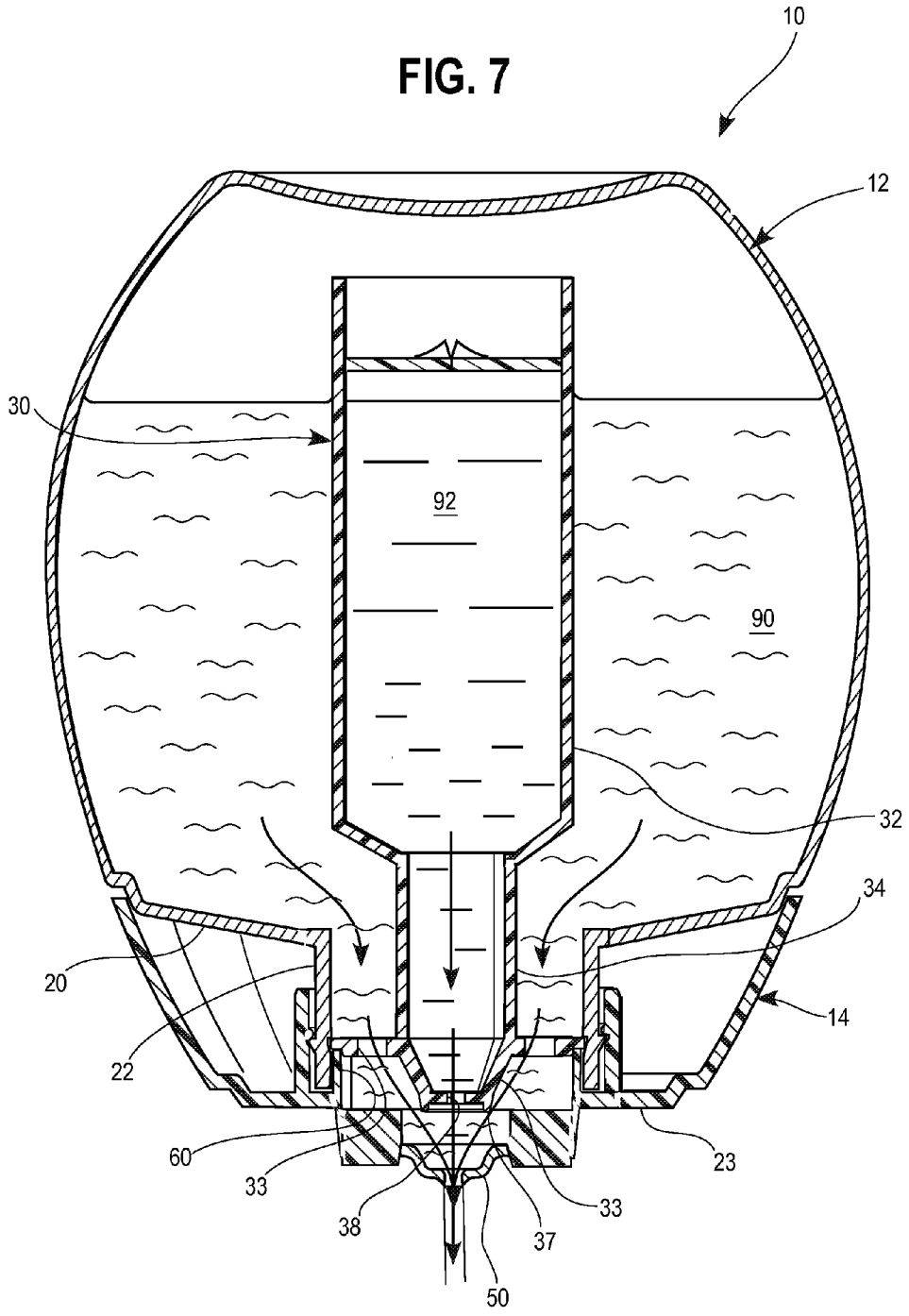
FIG. 7 is a cross-section view similar to that of FIG. 6, but showing the container dispensing the beverage concentrate with the valve in an open position unblocking the exit flow paths of the first and second components, with the lid of the cap removed for clarity.

The insert 30 of the first embodiment is configured to be inserted partially through the neck 22 of the body 12 of the container 10. In particular, when assembled, as depicted in FIGS. 6 and 7, the body portion 32 is disposed within the body 12 of the container 10, with the narrowed portion 34 spanning from the body 12 of the container 10 and into the neck 22 thereof. The purpose of the narrowed portion 34 is to ensure an adequately sized flow area of the first beverage component 90 along the exterior of the insert 30, particularly where the body 12 of the container 10 transitions to the neck 22 thereof. The outer edge of the support flange 36 at the upper end of the insert. 30 is configured to rest upon an inwardly extending ledge 62 formed in the neck 22 in order to support the insert 30 and restrict the same from further movement toward the bottom wall 18 of the body 12 of the container 10. After insertion of the insert. 30, the cap 14 can be attached to the neck 22 of the body 12 of the container 10. When attached, the inner flange 60 of the cap 14 is configured to about the support flange 36 of the insert to restrict upward movement of the insert 30 in a direction away from the bottom wail 18 of the body 12 of the container 10. In particular, a distal tip 31 of the inner flange 60 can abut the step 35 of the support flange 36 of the insert 30.

When the insert 30 is inserted into the body 12 of the container 10 and the cap 14 is attached to the neck 22 thereof and the container 10 of the first embodiment is in a non-dispensing configuration, illustrated in FIG. 6, the valve member 50 is positioned to fully engage the projecting rim 37 of the insert 30. This engagement has several objectives. A first of the objectives is to block the first beverage component 90 from exiting the body 12 of the container 10. A second of the objectives is to also block, the second beverage component 92 from exiting the body 12 of the container 10. A third of the objectives is to maintain isolation between the first and second beverage components 90 and 92.

Figure 26:
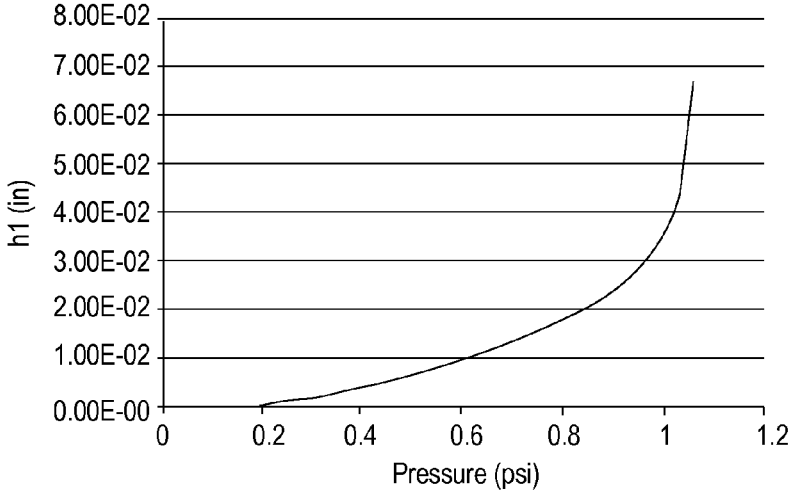
FIG. 26 is a representative graph comparing the pressure applied to the upstream side of the valve with the displacement of the valve away from the upper seat member in an exemplary model of the embodiment of FIG. 20.

With respect to the first of the objectives of the engagement between the project rim 37 of the insert 30 and the valve member 50, the valve member 50 is positioned to block the exit path of the first beverage component 90 from the body 12 of the container 10. The exit path of the first beverage component 90 extends between the narrowed portion 34 of the insert 30 and the neck 22, through the flow ports 33 and into a region bounded by the inner flange 60 of the cap, the bottom of the spout 46, a portion of the valve member 50, the projecting rim 37, the conical portion 31 of the insert 30, and the upper portion of the support flange 36 of the insert. The valve member 50 is movable between its closed position blocking the exit path of the first beverage component 90, illustrated in FIG. 6, and its open position permitting flow through the exit path of the first beverage component 90, illustrated in FIG. 7. In the open position of the valve member 50, the valve member 50 moves away from the project rim 37 of the insert 30 such that a space is formed therebetween for the first beverage component 90 to flow through and then force the slits of the valve member 50 to open and then exit therepast. In order to move the valve member 50 away from the projecting rim 37 or seat, it can be desirable that an initial increase in upstream pressure not cause the valve member 50 to begin moving away from the rim 37. In other words, it can be desirable to have a threshold upstream pressure that must be reached before the valve member 50 begins to move away from engagement with the rim 37. This bias or preload can advantageously reduce inadvertent leakage when the sidewall of the container 10 is unintentionally deflected by a small amount. The resistance of the valve member 50 from opening can be due at least in part to the required force to move from the concave orientation, in the closed position, to the convex orientation, including the stiffness of a support wall surrounding the membrane 52. In an exemplary embodiment, it is predicted that an upstream pressure of about 0.2 psi is required to move the valve member 50 away from its seat, as shown in the graph of FIG. 26. Furthermore, the bias or preload can contribute to having the pressure in the insert and the body equalize as part of the dispense cycle, which can contribute to consistency of dispensed amounts, including over multiple dispense cycles as the contents are depleted.

With respect to the second of the objectives of the engagement between the project rim 37 of the insert 30 and the valve member 50, when the valve member 50 is in its closed position, illustrated in FIG. 6, the valve member 50 is positioned to block the exit path of the second beverage component 92 from the body 12 of the container 10. The exit path of the second beverage component 92 extends from the interior of the insert body 32, through the narrowed portion 34, the conical portion 31 and the exit orifice 38 where it enters a small chamber between the top of the conical portion 31, the projecting rim, and the underside of the valve member 50. When the valve member 50 is in its closed position, illustrate in FIG. 6, the slits of the valve member 50 are closed and block the exit path of the second beverage component 92. However, when the valve member 50 is moved to its open position, such as when the body 12 of the container 10 and/or the insert body is squeezed, the valve member 50 shifts to its open position and the slits can open to permit the second beverage component 92 to flow therethrough.

With respect to the third of the objectives, isolation between the first and second beverage components 30 and 92 is accomplished when the valve member 50 is in engagement with the projecting rim 37 of the insert, as illustrated in FIG. 6. When the valve member 50 is moved to its open position, illustrated in FIG. 7, the first and second beverage components 90 and 92 are permitted to mix upstream of the valve member 50 before exiting through the open slits thereof.

With respect to the second version, the insert 87 includes multiple components, including an upper insert 70 (second container embodiment) or 170 (third container embodiment), a lower insert 80 (second container embodiment) or 180 (third container embodiment), and a flexible bag 89, as illustrated in FIGS. 11-19 (second container embodiment) and 20-25 (third container embodiment). The upper insert 70 or 170 is retained by the cap 14 and carries a seat for the valve member 50. Retaining the upper insert 70 or 170 and its valve seat on the same component, i.e., the cap, as the valve member 50 can advantageously provide for improved tolerance control for the seating of the valve member 50. The lower insert 80 or 180 is retained by the neck 22 of the body 12 of the container 10, and is configured to cooperate with the upper member 70 or 170 to define in part the exit flow paths of the first and second beverage components 90 and 92.

The flexible bag 89 depends from the lower component 80 and extends into the interior of the body 12 of the container 10 for containing the second beverage component 92. The flexible bag 89 can advantageously expand to a volume greater than would be possible to insert through the neck 22 if filled prior to insertion. That is, if the bag 89 is fully filled after insertion, then the neck 22 does not pose the same constraints to volume. This can allow for greater flexibility in the volume ratios of the first and second beverage components 90 and 92. The bag 89 preferably is formed from a material with a low modulus of elasticity such that it will not significantly expand, e.g., a non-extensible bag material such as a PET/PE laminate. A stiffener or stiffened region may be formed in the bag 89 to assist to maintaining the bag 89 is a preferred orientation, such as by forming a perimeter seam with a relatively stiffer material or stiffened seal.

Figure 14:
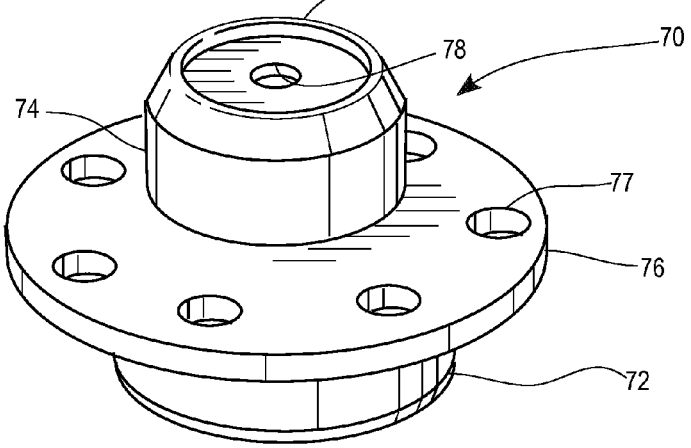
FIG. 14 is a perspective view of the upper insert of the second container embodiment shown in FIG. 11.
Figure 16:
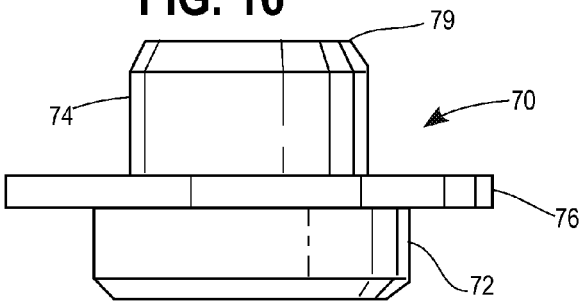
FIG. 16 is a side elevation view of the upper insert of the second container embodiment shown in FIG. 11.

The upper insert 70 of the second embodiment of a container includes a lower, hollow cylindrical portion 72, an intermediate flange 76, and an upper, hollow cylindrical portion 74, as illustrated in FIGS. 14-16. In the exemplary second embodiment, the intermediate flange 76 is of a larger diameter than both the lower and upper cylindrical portions 72 and 74, and the lower cylindrical. portion 72 is of a larger diameter than the upper cylindrical portion 74. A plurality of flow ports 77 extend through the intermediate flange 76. The top of the upper cylindrical portion 74 includes a projecting rim or valve seat 79 surrounding a central exit orifice 78.

Figure 24:
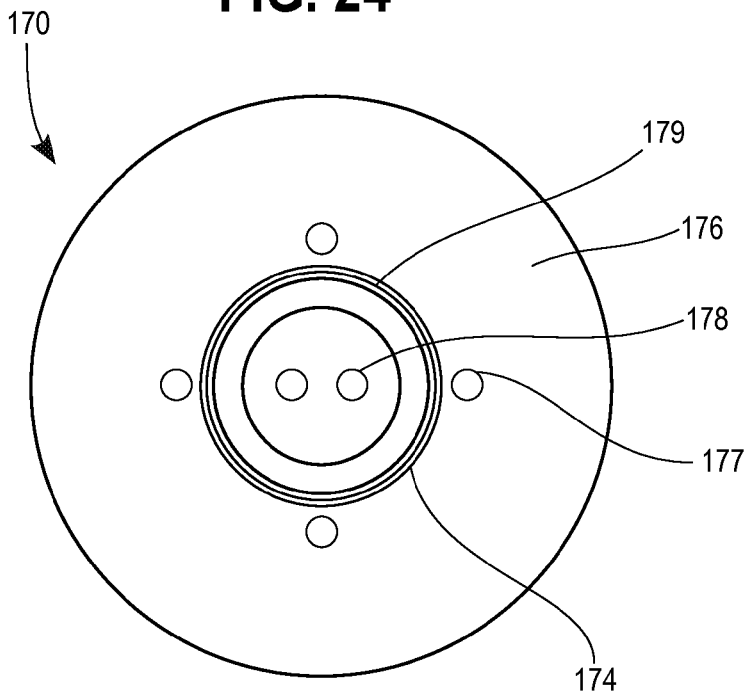
FIG. 24 is a top plan view of the upper insert of FIG. 20.
Figure 25:
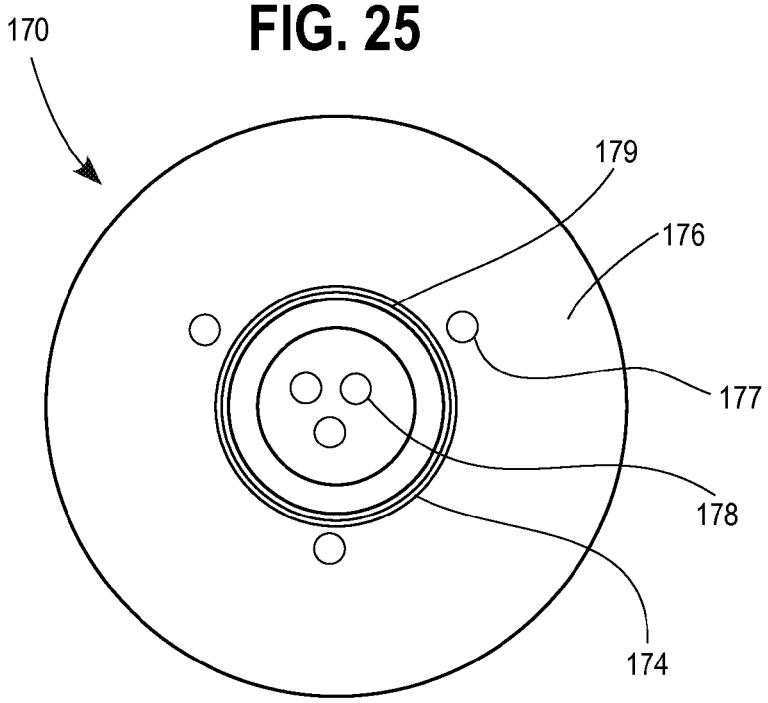
FIG. 25 is a top plan view of an alternative upper insert.

The upper insert 170 of the third embodiment of a container includes a lower, hollow cylindrical portion 172, an intermediate flange 176, and an upper, hollow cylindrical portion 174, as illustrated in FIGS. 20, 24 and 25. The intermediate flange 176 is of a larger diameter than both the lower and upper cylindrical portions 172 and 174, and the lower cylindrical portion 172 is the same or about the same diameter as the upper cylindrical portion 174. A plurality of flow ports 177 extend through the intermediate flange 176 for use in dispensing the first beverage concentrate. The top of the upper cylindrical portion 174 includes a projecting rim or valve seat 179 surrounding a plurality of exit orifices 178 for use in dispensing the second beverage concentrate.

Unlike the illustrated upper insert 70 (FIGS. 14-16) of the second container embodiment, the upper insert 170 (FIGS. 20, 24 and 25) of the third container embodiment has flow ports 177 that are the same size as or substantially the same size as the exit orifices 178. In an exemplary embodiment, the flow ports 177 and exit. orifices 178 can each be between about 0.01 and 0.1 inches in diameter, and preferably through not necessarily between about 0.02 and 0.03 inches in diameter, although other, non-circular shapes and other diameters can also be suitable. The matching of sizes of the flow ports 177 and exit orifices 178 advantageously can contribute to consistent dispensing ratios of the first and second beverage components 90 and 92 across a range of pressures, such as pressures generated by squeezing the outer body 12 of the container 10 during normal use. For example, it is predicted that the matching of sizes of the flow ports 177 and exit orifices 178 can contribute to similar ratios, such between about the same and about 5%, 10% or 25% of a desired ratio, between the pressure inside the body 12 and the pressure inside the flexible bag 89 for the same squeeze force, including with varying amounts of first and second beverage components, e.g., full, half full, etc. This is because the most restrictive portion of the flow path is being used to provide for similar flow rates across the same driving or internal pressure.

Figure 23:
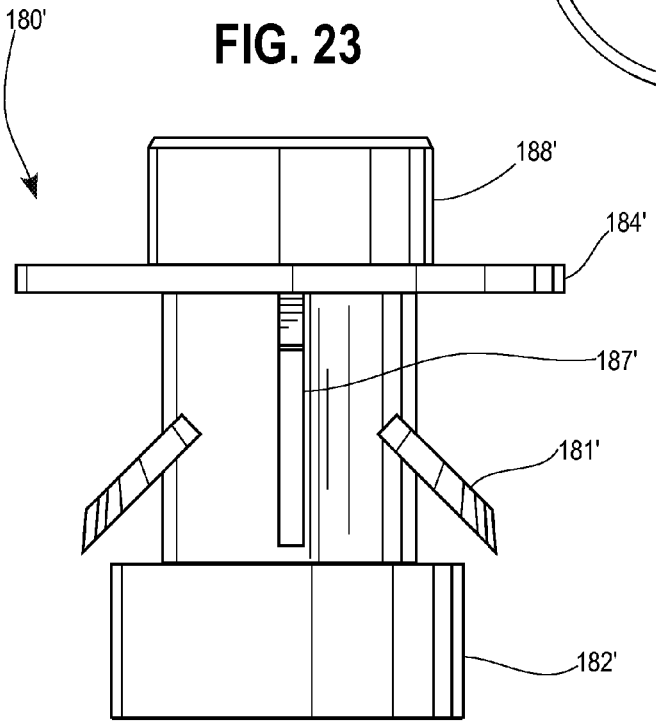
FIG. 23 is a side elevation view of an alternative lower insert.

The relative number of the flow ports 177 as compared to exit orifices 178 can be selected to achieve a desired ratio of the first and second beverage components and 92. For example, for a 1:1 ratio of first and second beverage components 90 and 92, the number of flow ports 177 for use in dispensing the first beverage concentrate 90 can be the same as the number of exit orifices 178 for use in dispensing the second beverage concentrate 92. Although the upper insert 170 can have three flow ports 177 and three exit orifices 178, as illustrated in FIG. 24, other numbers can also be suitable, e.g., one, two, four, five, etc. of each. In another example, for a 2:1 ratio of first and second beverage components 90 and 92, the number of flow ports 177 for use in dispensing the first beverage concentrate 90 can be twice the number of exit orifices 178 for use in dispensing the second beverage concentrate 92. Although the upper insert 170 can have four flow ports 177 and two exit orifices 178, as illustrated in FIG. 23, other numbers of flow ports/exit orifices can also be suitable, e.g., 2/1, 6/3, 8/4, etc. Other ratios can also be achieve by varying the relative number of flow ports 177 and exit orifices 178, such as rations of 3:2, 4:3, etc., and the number of exit orifices can be greater than the number of flow ports.

Figure 13:
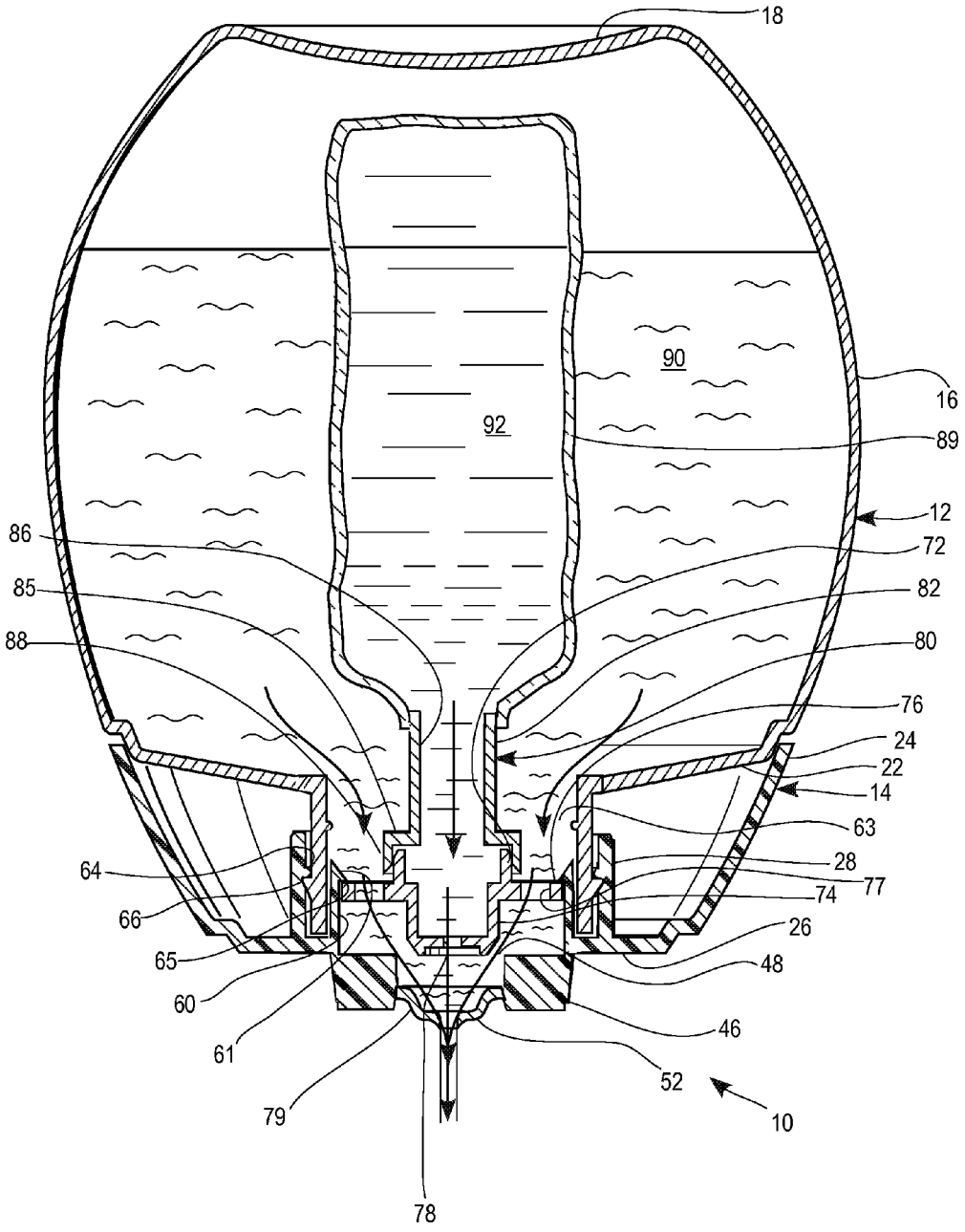
FIG. 13 is a cross-section view similar to that of FIG. 12, but showing the container dispensing the beverage concentrate with the valve in an open position unblocking the exit flow paths of the first and second components, with the lid of the cap removed for clarity.
Figure 17:
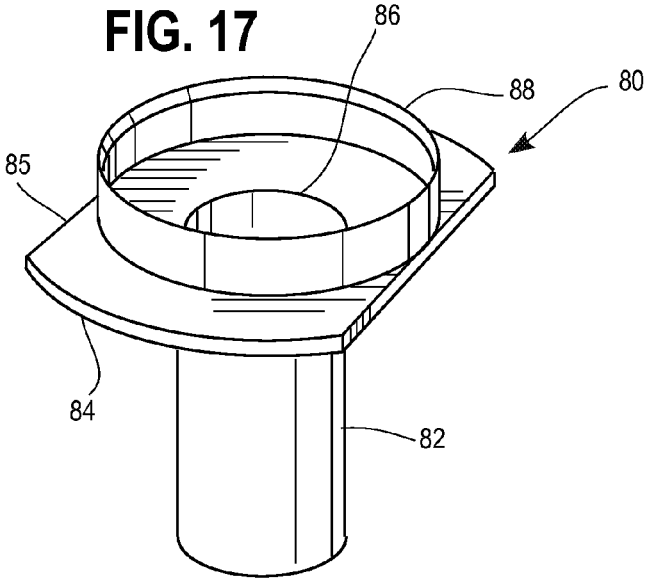
FIG. 17 is a perspective view of the lower insert of the second container embodiment shown in FIG. 11.
Figure 18:
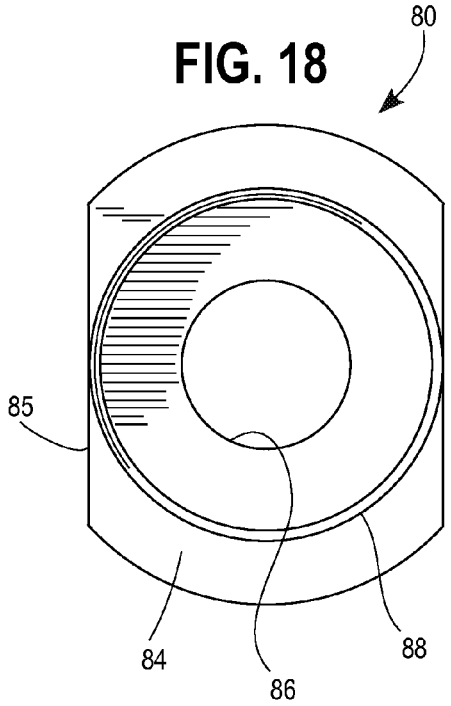
FIG. 18 is a top plan view of the lower insert of the second container embodiment shown in FIG. 11.
Figure 19:
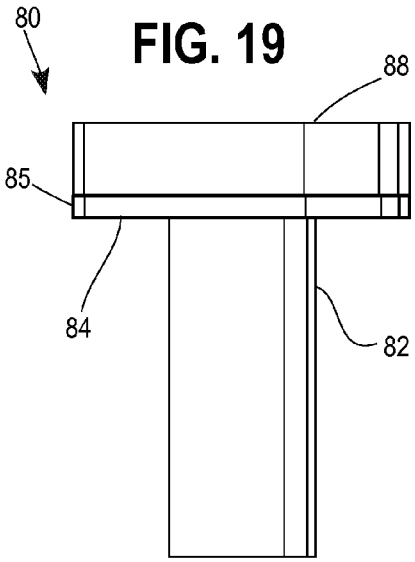
FIG. 19 is a side elevation view of the lower stem member of the second container embodiment shown in FIG. 11.
Figure 21:
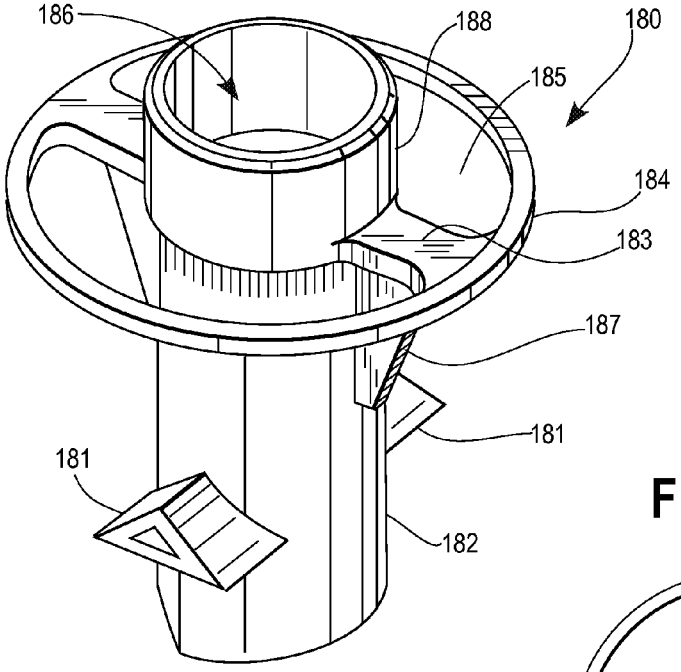
FIG. 21 is a perspective view of the lower insert of FIG. 20.
Figure 22:
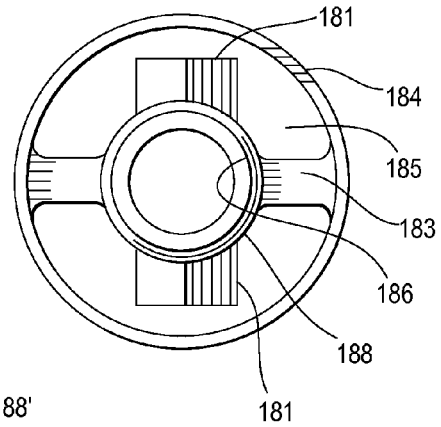
FIG. 22 a top plan view of the lower insert of FIG. 20.

The lower insert SO of the second container embodiment includes an intermediate platen 84, a depending, hollow stem 82, and an upending, circumferential protrusion 88, as illustrated in FIGS. 17-19. The platen 84 has a generally circular footprint at certain segments, with opposing flattened edges 85 that deviate from an imaginary circle. The upper end of the flexible bag 89 can be sealed to the lower end of the stem 82, as illustrated in FIGS. 12 and 13, so that the second beverage component 92 can be dispensed from the bag 89 through the lower insert 80, The lower insert 180 of the third container embodiment includes a hollow stem 182 and an upper circumferential protrusion 188 which together define an interior flow passage 186, as illustrated in FIGS. 20-22. Extending outwardly from opposing sides of the protrusion 188 is a pair of support arms 183. The ends of the support arms 183, opposite the protrusion 188, are connected to a retaining ring 184 and support the same in a spaced position from the protrusion 188 and stem 182 such that gaps 185 are defined between the ring 184 and the protrusion 188 and between the support arms 183. A pair of ribs 187 extended downwardly from the support arms 183 and span between the support arms 183 and the stem 182 to provide support for the arms 183. The hollow stem 182 has a smaller diameter than the protrusion 188 such than an interior step is defined at their intersection. Like the insert 80 of the second container embodiment, the upper end of the flexible bag 89 can be sealed to the lower end of the stem 182 of the third container embodiment, as illustrated in FIG. 20, so that the second beverage component 92 can be dispensed from the bag 89 through the lower insert 180. A pair of deflectors 181 are disposed on respective opposing sides of the lower stem 182, as will be discussed in greater detail below.

When assembled, as shown in FIGS. 12, 13 and 20, the upper insert 70 or 170 is retained by the cap 14 and the lower insert 80 or 180 is retained by the neck 22 of the body 12 of the container 10. More specifically, the neck 22 has an inwardly extending, circumferential protuberance 63. For the second container embodiment, the outer periphery of the intermediate platen 84 of the lower insert 80 rests on the protuberance 63. For the third container embodiment, the retainer ring 184 rests on the protuberance 63. An optional ramp (not shown) can be provided on the neck 22 above the protuberance 63 thereof to restrict removal of the upper insert 70 or 170. The inner flange 60 of the cap 14 has a distal end with a ramp inclined inwardly and terminating at a circumferential ledge 65. The ramp 61 of the inner flange 60 of the cap 14 facilitates insertion and restricts removal of the upper insert 70 or 170 relative thereto and, in particular, with respect to the flange 76 or 176. In the second container embodiment, the outer side of the lower cylindrical portion of the upper insert 70 is preferably in frictional or sliding engagement against the inner side of the circumferential protrusion 88 of the lower insert 70 such that a fluid connection is formed therebetween. Similarly, in the third container embodiment, the outer side of the lower cylindrical, portion 172 of the upper insert 170 is preferably in frictional or sliding engagement against the inner side of the circumferential protrusion 188 of the lower insert 170 such that a fluid connection is formed therebetween.

An exit path of the first beverage component 90 extends along the outer periphery of the lower stem 82 or 182 of the lower insert 80 or 180 and between the stem. 82 or 182 and the neck 22 of the body 12 of the container 10; between the neck 22 and the flattened edges 85 of the platen 84 of the lower insert 80 (in the second container embodiment) or between the neck 22 and the gaps 185 of the lower insert 180 (in the third container embodiment) between the neck 22 and the outer side of the circumferential protrusion 88 or 188 of the lower insert 70 or 170; through the flow ports 77 or 177 in the intermediate flange 76 or 176 of the upper insert 70 or 170; between the inner side of the inner flange 60 of the cap 14, the outer side of the upper cylindrical portion 74 or 174 of the upper insert 70 or 170, the underside of the spout 46 of the can 14, and the portion of the valve member extending from the underside of the spout 46 to the projecting rim 79 or 179 of the upper cylindrical portion 74 or 174.

The exit path of the second beverage component 92 extends from within the flexible bag 89, the passage 86 or 186 in the stem 82 or 182 of the lower insert 80 or 182, through the upper insert 70 or 170 and out of the exit orifice(s) 78 or 178 thereof.

When the valve member 50 is in the closed position, illustrated in FIGS. 12 and 20, the engagement of the valve member 50 with the projecting rim 79 or 179 of the upper insert 70 or 170 blocks both the exit flow path of the first beverage component 90, the exit flow path of the second beverage component 92 (by virtue of the slits of the valve member 50 being closed), and flow between the exit flow paths.

The valve 50 can be moved from its closed position to its open position upon squeezing of the sidewall of the body 12 of the container 10 upon initiation of a dispensing cycle. When the valve member 50 is in the open position, illustrated in FIG. 13, with the valve member SO spaced from the projecting rim 79 of the upper insert 70, the first exit flow path is unblocked, and the first beverage component 90 can pass through the slits of the valve member 50 and the second exit flow path is also unblocked, and the second beverage component 92 can pass through the slits of the valve member 50. The first and second beverage components 90 and 92 can combined either upstream of the valve member 50 or downstream of the valve member 50 to form the combined beverage concentrate 94, which can be in the form of a jet downstream of the valve member 50 during a dispensing segment of a dispensing cycle.

The resiliency of the body 12 of the container, discussed in further detail below, causes the container body 12 to tend to return to its unsqueezed configuration once it is no longer being squeezed. This draws air through the valve member 50 in an aspiration segment of the dispensing cycle. However, when the valve member SO returns to its closed position after dispensing, which can be due in part to the structure of the valve member 50, and the container body 12 is no longer being squeezed, the valve member 50 is seated on the valve seat 79 or 179 of the upper insert 70 or 170. The seated valve member 50 can restrict, or block airflow into the body 12 while permitting airflow into the bag 89 (or, in the case of the first container embodiment, into the cylindrical body portion 32). When a flexible bag 89 is used, this aspiration can cause the volume of air within the bag 89 to increase. With the insert 30, the aspiration can cause the bottom wall thereof to move toward the bottom end of the body portion 32 and/or air to be vented through a one-way valve into the interior of the body 12.

Figure 27:
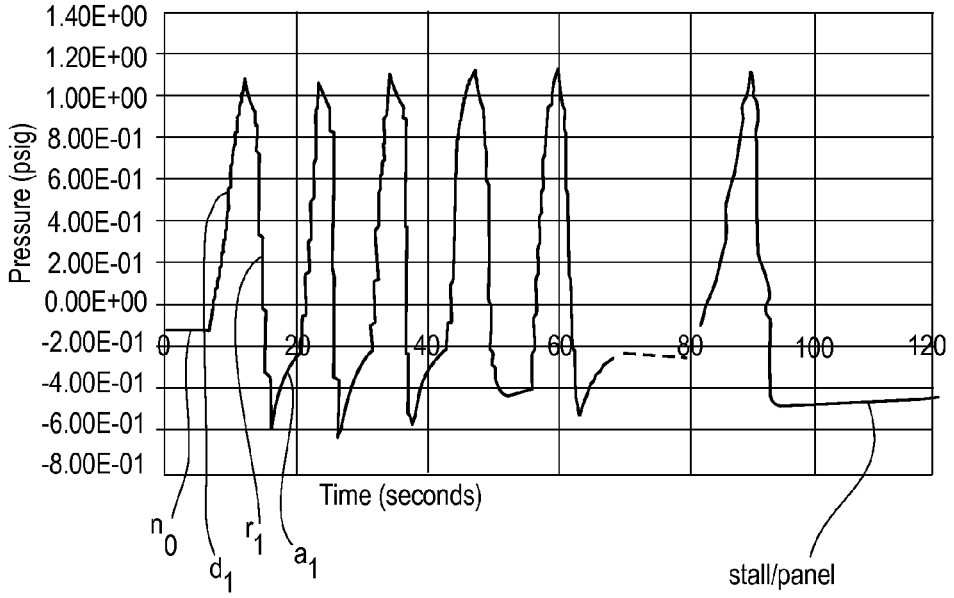
FIG. 27 is a representative graph comparing the pressure within the container body over time for multiple dispense and aspiration cycles.

The predicted pressure within the bag 89 over time for multiple dispense cycles is illustrated in FIG. 27. When the bag is initially at rest, the pressure within the bag is below 0, as shown by segment $n_0$. As the pressure within the bag is increased (as would occur during application of a squeeze force to the sidewall of the container body 12), the dispense segment, is initiated in order to dispense the first and second beverage components in a jet. Once the application of pressure is ceased (as would occur when the sidewall is no longer being squeezed), a return segment $r_1$ takes place, whereby the pressure reduces to below 0 to a maximum negative pressure due to the sidewalls of the container returning to their unsqueezed configuration. After the maximum negative pressure is reached, there is an aspiration segment: $a_1$ where the pressure increases to a point, still negative, until the pressure is increased again to initiate another dispense cycle. The slight negative pressure before the initial dispense and after each dispense cycle advantageously can assist in maintaining the valve member 50 in its closed position. When the aspiration segment of the dispense cycle can no longer occur after a predetermined number of dispense cycles, as will be discussed in greater detail below, the pressure within the bag will remain negative and the container 10 will stall, with the sidewall potentially being slightly or heavily paneled as a visual indication that the predetermined number of dispense cycles has been reached or exceeded.

In an exemplary embodiment, the bag 89 can have a volume capacity that is substantially larger than the initial volume of the second beverage component 92. The excess volume capacity of the bag 89 can be initially empty. During the aspiration segment of the dispensing cycle, that excess volume capacity of the bag 89 can be progressively filled with airflow through the valve member as the body 12 of the container 10 returns to its unsqueezed configuration. The volume of the incoming airflow for a given dispense cycle can be approximately the same combined volume of the first and second beverage components 90 and 92 that have been dispensed in the cycle, However, because the valve member 50 in its closed position can restrict or block airflow into the interior of the body 12, the incoming airflow predominately flows into the bag and progressively fills the excess volume capacity of the bag 89 with air. This results in a filled bag volume that progressively increases the contents of the container 10 are dispensed.

Having the filled bag volume increase has multiple advantages. For instance, it can assist in reducing the formation of wrinkles and folds in the bag 89, which could hinder dispensing of the second beverage concentrate. Another advantage is that it can contribute to consistent dispense ratios over multiple dispense cycles, as will be discussed in greater detail below. Yet another advantage is that it can contribute to providing a visual indication that a predetermined number of dispense cycles have been completed, as will also be discussed in greater detail below.

EXAMPLE 1

By way of example, a container can be configured for dispensing twelve doses of 4 cc combined of the first and second beverage components 90 and 92 in a 1:1 ratio. The container can be configured for the 1:1 dispense ratio at least in part by having even numbers of same sized flow ports 177 and exit orifices 178 of the upper insert 170, for example, as discussed above. The Initial liquid volume (i.e., Dispense Cycle 0) of the first and second beverage components 90 and 92 can each be 24 cc. Each dispense cycle can result in 2 cc of each of the first and second beverage components 90 and 92 being dispensed, thereby decreasing each of the body 12 liquid volume and the bag 89 liquid volume by 2 cc. The dispensing segment of the dispense cycle is followed by the aspiration segment, whereby an equivalent or substantially close thereto to the total liquid volume dispensed of air is introduced into the bag 89, in this example 4 cc of air. The total bag volume is 44 cc. The dispense cycles can continue until the bag liquid volume is depleted. An illustrative comparison of the body liquid volume, bag liquid volume, bag air volume, bag filled volume, system balance volume, and system status with respect to pressure balance for a given dispense cycle is set forth in the below table:

| After Dispense Cycle | Body Liquid Volume | Bag Liquid Volume | Bag Air Volume Increase | Bag Total Volume | System Balance Volume | System Status |
|---|---|---|---|---|---|---|
| 0 | 24 | 24 | 0 | 24 | 0 | Neutral |
| 1 | 22 | 22 | 4 | 26 | 0 | Slight Negative |
| 2 | 20 | 20 | 8 | 28 | 0 | Slight Negative |
| 3 | 18 | 18 | 12 | 30 | 0 | Slight Negative |
| 4 | 16 | 16 | 16 | 32 | 0 | Slight Negative |
| 5 | 14 | 14 | 20 | 34 | 0 | Slight Negative |
| 6 | 12 | 12 | 24 | 36 | 0 | Slight Negative |
| 7 | 10 | 10 | 28 | 38 | 0 | Slight Negative |
| 8 | 8 | 8 | 32 | 40 | 0 | Slight Negative |
| 9 | 6 | 6 | 36 | 42 | 0 | Slight Negative |
| 10 | 4 | 4 | 40 | 44 | 0 | Slight Negative |

-continued

| After Dispense Cycle | Body Liquid Volume | Bag Liquid Volume | Bag Air Volume Increase | Bag Total Volume | System Balance Volume | System Status |
|---|---|---|---|---|---|---|
| 11 | 2 | 2 | 44 | 44 | −2 | Slight Panel |
| 12 | 0 | 0 | 44 | 44 | −4 | Heavy Panel |

Although in the foregoing example both the body 12 and the baa 89 dispense 2 cc of beverage component until they are depleted, in practice the amounts dispensed may not be as precise. For example, the first beverage component 90 and the second beverage component 92 may each be dispensed in quantities varying by ±1%, 2%, 5%, etc. Such variations can result, in remainders of beverage component 90 or 92 that are less than desired. Moreover, the liquid volume in the body 12 can decrease faster than in the bag 89, and vice versa. The result of such variations can be a last dose with a ratio that substantially deviates from the desired ratio. To address such circumstances, it can be preferably to fill the body and the bag 89 such that there will generally be a depletion of the contents of the bag 89 prior to depletion of the contents of the body 12. Depleting the contents of the bag 89 prior to the contents of the body 12 can advantageously cause the operation of the container to stall when the contents of the bag 89 are depleted. By stalling, what is meant is that the aspiration segment of a dispense cycle cannot be completed. An incomplete aspiration segment of a dispense cycle can result in the sidewall of the body 12 remaining in an inwardly deflected orientation or paneled, as if it were still being squeezed, thereby providing a visual indication that the container 10 has reached its last dispense cycle.

EXAMPLE 2

In another example, a container can be configured for dispensing twelve doses of 5 cc combined of the first and second beverage components 90 and 92 in a 3:2 ratio. The container can be configured for the 3:2 dispense ratio at least in part by having a 3:2 ratio in the number of same sized flow ports 177 and exit orifices 178 of the upper insert 170, for example, as discussed above. The initial liquid volume (i.e., Dispense Cycle 0) of the first and second beverage components 30 and 92 can each be 38 and 24 cc, respectively. Each dispense cycle can result in 3 cc of the first beverage component 90 and 2 cc of the second beverage component 92 being dispensed, thereby decreasing the body 12 liquid volume by 3 cc and the bag 89 liquid volume by 2 cc. The total bag volume or size can be 54 cc. The dispensing segment of the dispense cycle is followed by the aspiration segment, whereby an equivalent or substantially close thereto to the total liquid volume dispensed of air is introduced into the bag 89, in this example 5 cc of air. The dispense cycles can continue until the bag liquid volume is depleted. An illustrative comparison of the body liquid volume, bag liquid volume, bag air volume, and bag filled volume for a given dispense cycle is set forth in the below table:

| After Dispense Cycle | Body Liquid Volume | Bag Liquid Volume | Bag Air Volume Increase | Bag Total Volume | System Balance Volume | System Status |
|---|---|---|---|---|---|---|
| 0 | 38 | 24 | 0 | 24 | 0 | Neutral |
| 1 | 35 | 22 | 5 | 27 | 0 | Slight Negative |

-continued

| After Dispense Cycle | Body Liquid Volume | Bag Liquid Volume | Bag Air Volume Increase | Bag Total Volume | System Balance Volume | System Status |
|---|---|---|---|---|---|---|
| 2 | 32 | 20 | 10 | 30 | 0 | Slight Negative |
| 3 | 29 | 18 | 15 | 33 | 0 | Slight Negative |
| 4 | 26 | 16 | 20 | 36 | 0 | Slight Negative |
| 5 | 23 | 14 | 25 | 39 | 0 | Slight Negative |
| 6 | 20 | 12 | 30 | 42 | 0 | Slight Negative |
| 7 | 17 | 10 | 35 | 45 | 0 | Slight Negative |
| 8 | 14 | 8 | 40 | 48 | 0 | Slight Negative |
| 9 | 11 | 6 | 45 | 51 | 0 | Slight Negative |
| 10 | 8 | 4 | 50 | 54 | 0 | Slight Negative |
| 11 | 5 | 2 | 52 | 54 | −3 | Slight Panel |
| 12 | 2 | 0 | 54 | 54 | −6 | Heavy Panel |

In the foregoing second example, the initial body liquid volume is greater than the amount that will ultimately be dispensed. At the end of the 12th dispense cycle, there is 2 cc of the first beverage component remaining but 0 cc of the second beverage component remaining. If the bag 89 is sized to only have a maximum filled volume of 54 cc, then further dispensing can effectively be limited. When the bag 89 can no longer complete the aspiration segment of the dispense cycle, the container body 12 can remain slightly or heavily paneled in an inwardly deflected orientation as a visual indicator that the predetermined number of dispense cycles has been completed.

The foregoing containers described herein may have resilient sidewalls that permit them, to be squeezed to dispense the liquid concentrate or other contents. In particular, the body 12 of the container 10 can be resilient. By resilient, what is meant that they return to or at least substantially return to their original configuration when no longer squeezed. Further, the containers may be provided with structural limiters for limiting displacement of the sidewall, i.e., the degree to which the sidewalls can be squeezed. This can advantageous contribute to the consistency of the discharge of contents from the containers. For example, the insert can function as a limiter when the opposing portions of the sidewall contact it, particularly when the cartridge is less resilient or more rigid than the container body. The depth and/or cross-section of the insert or components thereof can be varied to provide the desired degree of limiting. Other structural protuberances of one or both sidewalls (such as opposing depressions or protuberances) can function as limiters, as can structural inserts. The insert and, in particular the portion thereof holding the second beverage component 92 can be resilient, or can be flexible to a degree that it is not resilient.

Figure 28:
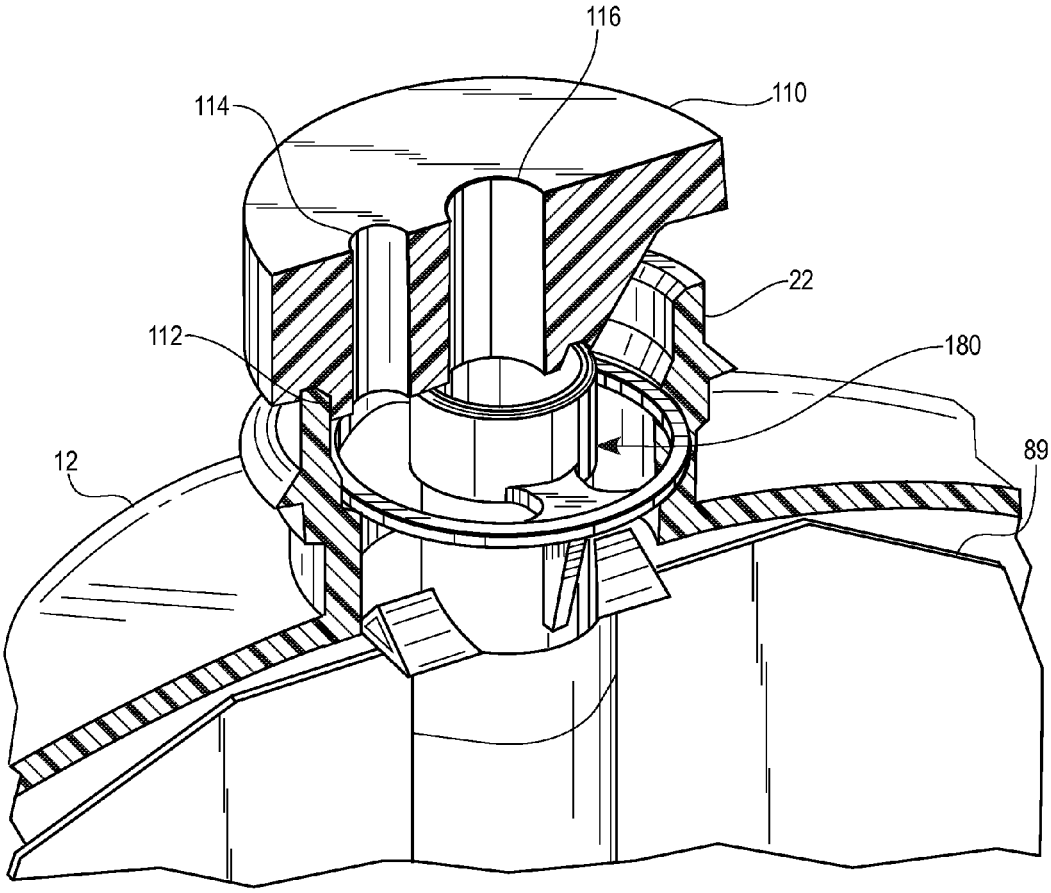
FIG. 28 is a partial cross section of the body and lower stem member of the embodiment of FIG. 20 showing a filling tool being used for filling the body and the flexible bag.

In order to assemble and fill the container 10 of the second and third embodiments, the lower insert 80 or 180 is provided with the attached bag 89 in a rolled up configuration such that it can inserted into the body 12 through the opening of the neck 22. Once inserted into position, a filling tool 110 can optionally be used to fill both the body 12 and the bag 89 (if the latter is not already provided filled). More specifically, the filling tool 110 can have an annular groove 112 adapted to partially receive the upper end of the neck 22 to seat the tool 110, as illustrated in FIG. 28. A vent is present when the tool 110 is seated on the neck 22 to allow for the egress of gasses from the interior of the body 12 during filling. The vent can be formed as a vent aperture in the tool 110 and/or a portion of the tool 110 that does not seat on the neck 22.

The tool 110 has an inner aperture 116 aligned with the interior flow passage 86 or 186 of the lower insert 80 or 180 for filling the bag 89 with the second beverage component 92. The tool 110 also has an outer aperture 114 aligned with the space between the inner surface of the neck and one of the flattened edges 85 of the lower insert (for the second container embodiment) or one of the gaps 185 between the ring 184 and the protrusion 188 of the lower insert 180 (for the third container embodiment) for filling the body 12 with the first beverage component 90. The filling of the first and second beverage components 90 and 92 can occur separately, coextensively, or substantially simultaneously. With respect to the third container embodiment, during filling of the body 12 with the first beverage component 90 the deflectors 181 of the lower insert 180 can deflect the incoming liquid to either side of the top edge of the bag 89 to reduce splatter and improve flow. While the deflectors 181 are depicted as triangular, they can instead be inclined ramps 181', as illustrated in the alternative lower insert embodiment of FIG. 23 (with like reference numerals referring to similar parts).

After filling, the cap 14—already having the upper insert 70 or 170 attached thereto, can be attached to the neck 22 to complete the assembly and filling of the container 10. Alternatively, the upper insert 70 or 170 can be inserted into the opening of the neck 22 and then the cap 14 attached to the neck 22.

The drawings and the foregoing descriptions are not intended to represent the only forms of the containers and methods in regards to the details of construction, assembly and operation. Changes in form and in proportion of parts, as well as the substitution of equivalents, are contemplated as circumstances may suggest or render expedient.

The invention claimed is:

1. A container for isolating a first liquid and a second liquid prior to dispensing, the container comprising:
   - an enclosed body for containing the first liquid and having an opening;
   - a first exit flow path for dispensing the first liquid from the body;
   - an insert for containing the second liquid and at least partially received within the body to isolate the first and second liquids;
   - a second exit flow path for dispensing the second liquid from the insert; and
   - a flexible diaphragm valve member moveable from a closed position blocking both the flow paths and isolating the first and second liquids upstream of the valve to an open position unblocking both the first and second exit flow paths and permitting flow through both the first and second unblocked exit flow paths and through the valve member to dispense the first and second liquids from the container.

2. The container of claim 1, wherein the valve member, the first exit flow path and the second exit flow path are configured to permit mixing of the first and second fluids upstream of the valve when the valve is in the open position.

3. The container of claim 2, wherein the insert has a valve seat surrounding an exit opening of the insert, the first exit flow path being defined in part by an outer portion of the valve seat and the second exit flow path being defined in part by an inner portion of the valve seat.

4. The container of claim 3, wherein the valve member is a moveable from the closed position seated on the valve seat to the open position at least partially spaced from the valve seat.

5. The container of claim 4, wherein the flexible diaphragm includes one or more slits that can flex to form an opening for dispensing the first and second liquids from the container when in the open position.

6. The container of claim 1, wherein the body includes a neck disposed about the opening and the insert is at least partially supported by the neck.

7. The container of claim 6, wherein the insert has an outwardly extending protuberance and the neck has an inwardly extending rib, the protuberance of the insert and the rib of the neck being configured such that the protuberance of the insert rests on the rib to at least partially support the insert relative to the body.

8. The container of claim 7, wherein the first exit flow path includes a bypass segment extending between the neck and the exterior of the insert.

9. The container of claim 8, wherein the valve seat and the exit opening are formed in an upper portion of the insert, the exit opening being in fluid communication with a downwardly extending compartment containing the second fluid.

10. The container of claim 9, wherein the protuberance of the insert is formed on a peripherally-extending flange of the insert, the flange being configured to have one or more passages therepast to define the bypass segment of the first exit flow path.

11. The container of claim 10, wherein the compartment is spaced from the protuberance of the insert by a neck having a narrowed cross-section as compared to a cross-section of the compartment.

12. The container of claim 11, wherein the insert includes an upper seat member and a lower stem member, the upper seat member having the valve seat and the lower stem member having the compartment.

13. The container of claim 12, wherein the upper seat member and the lower stem member cooperate to form a fluid exit passage upstream of the exit opening.

14. The container of claim 13, wherein the protuberance of the insert is formed on a peripherally-extending flange in an upper portion of the insert, the flange having one or more passages therepast to define in part the bypass segment of the first exit flow path.

15. The container of claim 14, wherein the upper seat member has one or more passages therepast to define in part the bypass segment of the first exit flow path.

16. The container of claim 12, wherein a cap is attached to the neck of the body, the upper seat member being proximate to the cap.

17. The container of claim 16, wherein the cap and the upper seat member include means for retaining the upper seat member on the insert, and the lower stem member and the neck include means for retaining the lower stem member on the neck.

18. The container of claim 17, wherein the valve member is attached to the cap.

19. The container of claim 18, wherein the cap includes a lid moveable to selectively block access to the valve member.

20. A method of assembling a container for isolating a first liquid and a second liquid prior to dispensing, the method comprising:

inserting an insert into the outer body of the container through an opening thereof;

filling an outer body of the container with a first liquid through the opening;

filling the insert with the second liquid after the step of at least partially inserting the insert into the outer body of the container; and positioning a flexible diaphragm valve member relative to the opening to control flow of first and second liquids, the valve member moveable from a closed position blocking mixing of the first and second fluids to an open position unblocking both the first and second fluids and permitting dispensing of the unblocked first and second fluids together together through the valve member.

21. The method of claim 20, further including the step of supporting the insert with a neck of the outer body.

22. The method of claim 21, wherein the insert includes a valve seat configured to be engaged by the valve member when in the closed position.

23. The method of claim 22, further comprising venting the outer body during the step of filling the outer body with the first liquid and/or during the step of filling the insert with the second liquid.

24. The method of claim 23, wherein the insert has a lower compartment for the second fluid and an upper seat member having the valve seat, then method further comprising attaching the upper seat member to a cap and supporting the lower compartment with the neck of the outer body, and attaching the cap to the outer body and forming a fluid passage between the lower compartment and the upper seat member.

25. A method of dispensing a first liquid and a second liquid from a container which isolates the first liquid and a second liquid prior to dispensing using a common flexible diaphragm valve member, the method comprising:

squeezing the container to cause the valve member to move from a closed position blocking mixing of the first and second fluids upstream of the valve member to an open position unblocking both the first and second fluids and permitting dispensing of the unblocked first and second fluids together; and dispensing the first and second liquids together from the container when the valve member is in the open position.

26. The method of claim 25, wherein the step of dispensing the first and second liquids includes the step of dispensing the first and second liquids through an opening in the valve member.

27. The method of claim 26, wherein the first liquid is stored in a first liquid compartment and the second liquid is stored in a second liquid compartment, the method further comprising the step of drawing air into the second liquid compartment after the step of dispensing the first and second liquids together from the container when the valve member is in the open position such that a filled volume of the second liquid compartment increases in size beyond the volume of the second liquid dispensed in a dispense cycle.

28. The method of claim 27, wherein the step of squeezing the container to cause the valve member to move from the closed position to the open position further comprises the step of overcoming a vacuum within the second liquid compartment.

29. The method of claim 28, further including the step of opening a lid of a cap of the container, the lid blocking dispensing of the first and second liquids when closed.

30. The container of claim 1, wherein, in the closed position, the valve member is positioned in a concave orientation configured to block both the first and second exit flow paths and isolate the first and second liquids upstream of the valve, and wherein, in the open position, the valve member is positioned in a convex orientation to permit flow through both the first and second exit flow paths to dispense the first and second liquids from the container.

31. The container of claim 30, further comprising an inner plug positioned in contact with the valve member when the valve member is in the concave orientation, the inner plug being configured to restrict movement of the valve member from the concave orientation to the convex orientation.

32. The method of claim 20, further including positioning the valve member, when in the closed position, in a concave orientation blocking the mixing of the first and second fluids, and positioning the valve member, when in the open position, in a convex orientation permitting the dispensing of the first and second fluids together.

33. The method of claim 25, further including positioning the valve member, when in the closed position, in a concave orientation blocking the mixing of the first and second fluids upstream of the valve member, and positioning the valve member, when in the open position, in a convex orientation permitting the dispensing of the first and second fluids together.

34. A container for isolating a first liquid and a second liquid prior to dispensing, the container comprising:

an enclosed body for containing the first liquid and having an opening;

a first exit flow path for dispensing the first liquid from the body;

an insert for containing the second liquid and at least partially received within the body to isolate the first and second liquids, the insert including an upper seat member surrounding an exit orifice, the upper seat member including one or more flow ports therein that define in part a bypass segment of the first exit flow path;

a second exit flow path for dispensing the second liquid from the insert; and a flexible diaphragm valve member moveable from a closed position blocking both the flow paths and isolating the first and second liquids upstream of the valve to an open position permitting flow through both the first and second exit flow paths and through the valve member to dispense the first and second liquids from the container.

35. A container for isolating a first liquid and a second liquid prior to dispensing, the container comprising:

an enclosed body for containing the first liquid and having an opening;

a first exit flow path for dispensing the first liquid from the body;

an insert and a flexible bag depending therefrom for containing the second liquid and at least partially received within the body to isolate the first and second liquids;

a second exit flow path for dispensing the second liquid from the insert; and a flexible diaphragm valve member moveable from a closed position blocking both the flow paths and isolating the first and second liquids upstream of the valve to an open position permitting flow through both the first and second exit flow paths to dispense the first and second liquids from the container.

* * * * *